US005719592A

United States Patent [19]

Misawa

[11] Patent Number: 5,719,592

[45] Date of Patent: Feb. 17, 1998

[54] IMAGE REGENERATION DEVICE

[75] Inventor: Toshiyuki Misawa, Suwa, Japan

[73] Assignee: Seiko Epson Corporation, Tokyo, Japan

[21] Appl. No.: 371,653

[22] Filed: Jan. 11, 1995

Related U.S. Application Data

[63] Continuation of Ser. No. 69,502, Jun. 1, 1993, abandoned.

[30] Foreign Application Priority Data

Jun. 1, 1992 [JP] Japan ..... 4-140336
May 28, 1993 [JP] Japan ..... 5-151187

[51] Int. Cl.[6] ..... G09G 5/00

[52] U.S. Cl. ..... 345/113; 345/115; 345/118

[58] Field of Search ..... 345/113, 114, 345/115, 116, 123, 126, 127, 120, 119, 118, 1; 395/153, 154, 157, 340, 342; 382/293, 296, 298; 364/410

[56] References Cited

U.S. PATENT DOCUMENTS

| | | | |
|---|---|---|---|
| 4,324,401 | 4/1982 | Stubben | 345/121 |
| 4,647,971 | 3/1987 | Norman, III | 345/121 |
| 4,746,981 | 5/1988 | Nadan et al. | 345/1 |
| 4,790,025 | 12/1988 | Inoue | 382/45 |
| 4,819,068 | 4/1989 | Cooper | 348/441 |
| 4,831,445 | 5/1989 | Kawabe | 345/121 |
| 4,839,826 | 6/1989 | Urushibata | 345/126 |
| 4,890,833 | 1/1990 | Lantz | 345/113 |
| 4,929,085 | 5/1990 | Kajihara | 345/126 |
| 4,930,074 | 5/1990 | McCarthy | 345/121 |
| 4,975,977 | 12/1990 | Kurosu | 345/127 |
| 5,125,671 | 6/1992 | Ueda | 273/437 |
| 5,227,863 | 7/1993 | Bilbrey | 395/153 |

OTHER PUBLICATIONS

Mims, F. "Engineer's Notebook", Radio Shack 1980 pp. 22, 23, 69, 71.

Tandy, "TRS-80 Color Computer Technical Reference Manual" Fort Worth, 1981 p. 26.

*Primary Examiner*—Xiao Wu

[57] ABSTRACT

A microcode-controlled video display controller achieves special functions such as enlargement, reduction, and rotation by performing various transformations on the display screen coordinates in order to generate addresses for accessing a display memory containing image formation data. The transformed addresses are used to fetch display data and information in an order other than the order in which the data and information were originally stored in the display memory.

27 Claims, 22 Drawing Sheets

| CYCLE NO. | BUS A | BUS B 3 | |
|---|---|---|---|
| 0 | | | SCREEN ONE AT 1ST WORD OF CG ADDRESS. |
| 1 | | | AT 2ND WORD OF CG ADDRESS. |
| 2 | | | SCREEN TWO AT 1ST WORD OF CG ADDRESS. |
| 3 | | | AT 2ND WORD OF CG ADDRESS. |
| 4 | | | AT 3RD WORD OF CG ADDRESS. |
| 5 | | | AT 4TH WORD OF CG ADDRESS. |
| 6 | | | |
| 7 | | | |

SCREEN ONE BAT ADDRESS

| | COLOR | SCREEN |
|---|---|---|
| (A) | 256 | 1 |
| (B) | 16 | 2 |
| (C) | 16 | 1 4 1 |
| (D) | 16 | 1 |
| (E) | 4 | 2 |
| (F) | 4 | 1 |

MICROPROGRAM

| | |
|---|---|
| CYCLE 1 | SCREEN A NORMAL 16 COLOR |
| CYCLE 2 | SCREEN A NORMAL 16 COLOR |
| CYCLE 3 | SCREEN A NORMAL 16 COLOR |
| CYCLE 4 | SCREEN A NORMAL 16 COLOR |
| CYCLE 5 | SCREEN B NORMAL 4 COLOR |
| CYCLE 6 | SCREEN B NORMAL 4 COLOR |
| CYCLE 7 | NOP |
| CYCLE 8 | NOP |

IMAGE REGENERATION DEVICE

This is a continuation U.S. patent application Ser. No. 08/069,502, filed Jun. 1, 1993, now abandoned.

BACKGROUND OF THE INVENTION

1. Field of the Invention

This invention concerns an image regeneration device, or video display controller, that is used in equipment such as video games, computer graphics, personal computer displays and multi-media equipment.

2. Description of Related Art

Conventionally, image regeneration devices for the background screens used in equipment such as TV games are implemented as shown in FIG. 29. In this drawing, the signal that shows the x and y coordinates on the display screen that is generated by master counter 1 performs special processing, such as scrolling by means of scroll process 2, and then is input to address generation circuit 3. Next, the desired address that is generated at address generation circuit 3 is input to RAM 4. As a result, the character code that corresponds to the desired character will be output from RAM 4. The character code will be converted into the desired graphics data by going through graphics ROM 5 and then transferred to display device 6.

Conventionally, the number of background screens that are the subject of the processing of the image regeneration device described above is limited to one in most cases. In addition, even in a case where a plurality of background screens are subjected to processing, the number of screens is two at most. The number of display mode (number of colors) types also is two at most. As a result, in the image regeneration device shown in FIG. 29, the interconnections within each circuit block and between each block are formed of hardware logic that is not programmable; it is fixed.

In conventional image regeneration devices, complicated calculations are required, and it is not often that the enlargement, reduction and rotation modes, which cause the hardware to be large in size, are supported. Further, the image data read from the memory is arranged in display sequence at the time it is read.

Recently, a number of display modes have come to be demanded for the display devices of TV games, computer graphics, personal computers and for multi-media equipment. For instance, there are display modes from the 16.77 million natural image displays to four-color character displays. At the same time, where the number of displayable background screens is concerned, multiple screen displays such as four screens or even more than that have come to be required. There is also a demand for a variety of image processing in order to achieve high-level display effects, such as scrolling, rotation, enlargement, reduction and tiling.

If such demands are responded to by conventional image regeneration devices, which are based chiefly on hardware logic, the following major problems arise:

1) All of the combinations of the multiple display modes that come about due to the existence of a plurality of display mode types, a plurality of background screens and a multiple of image processing modes have to be implemented using hardware logic. As a result, the size of the circuitry will be huge and the wiring will be extremely complex.

2) The sequencer is extremely complex in order to access RAM 4, in which the image data is stored. At the same time, many people, a large amount of cost and much time are required for the sequencer design.

3) As a result of (1) and (2), creating an integrated circuit for this image regeneration device, will be extremely costly. In addition, even if microprograms are used, in order to respond to the demands described above, the following types of new circuit means will be required:

a) a means for handling multiple types of display modes, including the enlargement, reduction and rotation modes and the normal mode, in real time, in which the image regeneration device is in the smallest size hardware possible; and b) a circuit means for controlling the operation of an image regeneration device which has multiple display modes and a plurality of background screens, by means of microprograms set up by a programmer.

In addition, a means that will compensate for the display start timing offset, which results from adding circuit means (a) and (b) described above, and will match up the display timings between the enlargement, reduction and rotation modes and the normal mode is required. Further, during the normal mode, because the multiple screen background image data, which has multiple display modes that are read by the microprogram, normally are not arranged in the sequence of the dot units that are displayed on the display device, a means that rearranges these in the display sequence is required.

An objective of this invention is to resolve such problems and offer an image regeneration device that is able to realize high-level functions even though it is a small piece of hardware.

SUMMARY OF THE INVENTION

The image regeneration device has a means of generating coordinates on a display screen; a memory that stores data used for image formation, a means that generates addresses for the purpose of accessing the memory, a plurality of screens and a plurality of display modes, a microcode memory, a means that delays the microprograms, and a means that generates addresses for the purpose of accessing the memory while controlling the microprograms.

The image regeneration device also has a register that stores scroll parameters that correspond to the plurality of screens, and a scroll means that scrolls the regeneration images using the scroll parameters.

The image regeneration device has a register that stores reverse affine transformation parameters, and a reverse affine transformation means that enlarges, reduces and rotates the regeneration images using the reverse affine transformation parameters.

The image regeneration device has a register that stores the original image size that corresponds to the plurality of screens, and a region determination means that determines whether the coordinates are within the original image or outside of the original image, using the original image size while controlling the microprograms.

The output of the microcode memory is coupled through a parallel-serial converter to the input of the means that delays the microprogram.

The image regeneration device has a delay means that is formed from a selector that selects the program counter that indicates the current status within the basic sequence and selects the cycle sequence microprogram that corresponds to the current status, and a means that stores the microprogram in memory.

The image regeneration device has the microcode memory and delay means being formed from the selector that is formed to input the control signals that control the writing and retention of the microcode shift register and formed from the shift register that is connected in a ring shape.

The image regeneration device has a means of generating coordinates on a display screen, a memory that accumulates data used for image formation, and a means that generates addresses for the purpose of accessing the memory, and the image regeneration device has a plurality of display modes, including the enlargement, reduction and rotation modes and a normal mode. The image regeneration device also has a reverse affine transformation converter that causes the enlargement, reduction and rotation, a means that executes at least a portion of the reverse affine calculation before the reverse affine calculation of each dot, a circuit that rearranges the image data to the display sequence after accessing the memory in the normal mode, and a means that matches the effective display periods in the enlargement, reduction and rotation modes and the normal mode.

The image regeneration device is controlled by a microprogram, wherein the number of cycles contained in a basic cycle of the microprogram is stipulated by the integral multiples of the number of horizontal pixels of the characters.

The image regeneration device has a means that indicates that the display mode is either the normal mode or the enlargement, reduction or rotation mode. If the indication is for the normal mode, memory access will begin at least a character earlier than the start of the display. If the indication is for the enlargement, reduction or rotation mode, the calculation of the affine transformation initial value will take place before the display begins and the memory access will take place after that.

A second embodiment of the present invention has a means of generating coordinates on a display screen, a memory that stores data used for image formation, a means that generates addresses for the purpose of accessing the memory, microprograms that control the image regeneration device, a decoder in which the control data that follows the microprograms is input, a switching circuit that selectively switches the image data read from the memory based on control signals output from the decoder; a first buffer memory that temporarily stores image data that already has been switched; and a parallel-serial converter.

The second embodiment has a means that transfers individual pieces of the plurality of data accumulated in a second buffer memory, which is located between the first buffer and the parallel-serial converter, to the parallel-serial converter at an independent timing according to externally-set parameters.

Other objects, advantages and attainments together with a fuller understanding of the invention will become apparent and appreciated by referring to the following description and claims taken in conjunction with the accompanying drawings.

DETAILED DESCRIPTION OF THE INVENTION

First Embodiment

Figure 1:
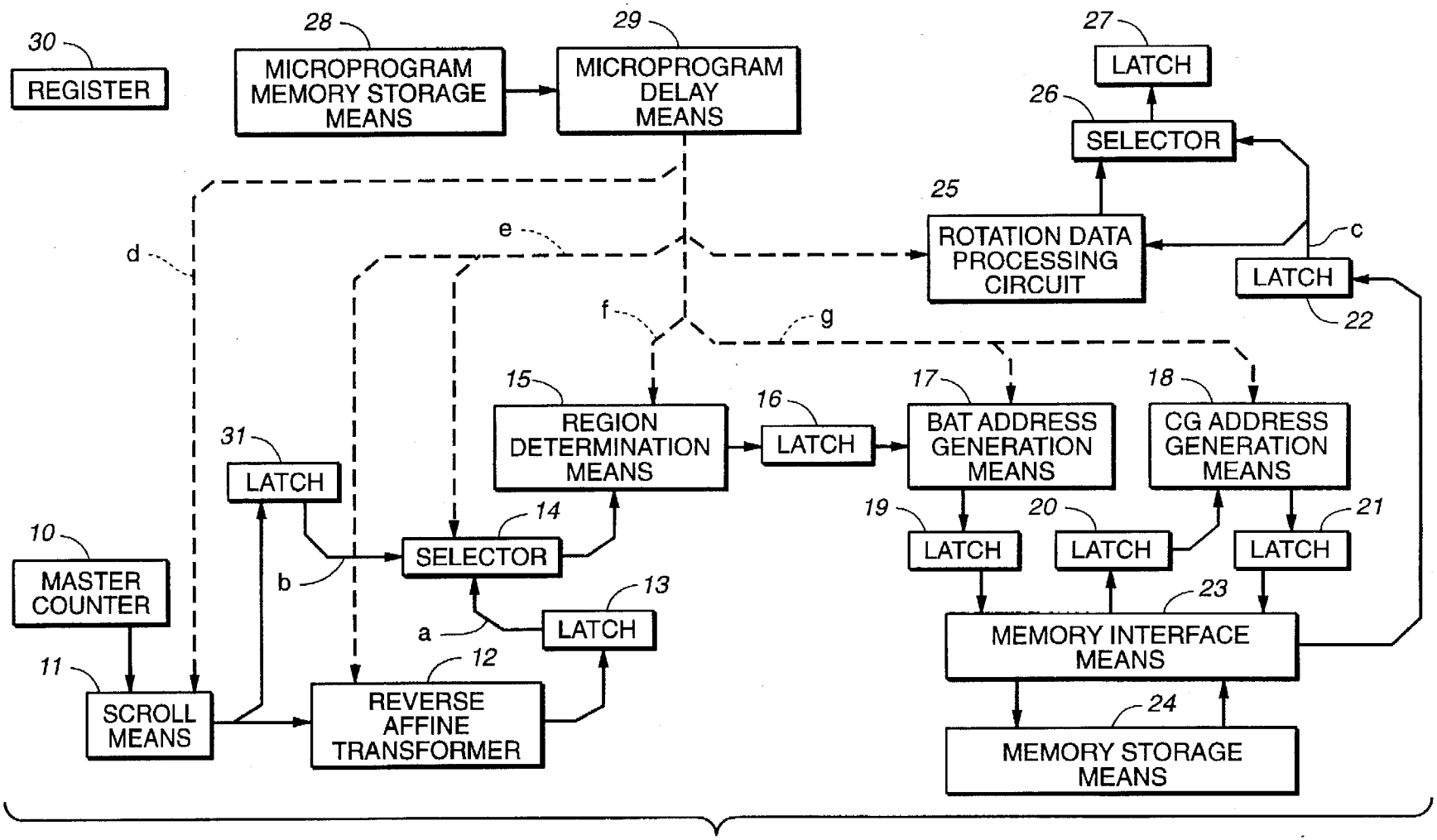
FIG. 1 is a block diagram describing the structure of the first embodiment of the invention.

FIG. 1 is a drawing that describes the structure of the first embodiment of the image regeneration device of this invention using the case of interactive computer graphics, which is represented by equipment such as TV games and multimedia personal computers, and so on. The image regeneration device is equipped with a scroll function and enlargement, reduction and rotation functions, and an address generation function for accessing the memory function that either stores image data or all of the data required to generate the image data. In addition, the image regeneration device is equipped with a means that implements a plurality of display screens and multiple types of display color modes. A portion of the hardware or all of the hardware, which implements each of the functions that have been given to the image regeneration device, operates according to microprograms.

Referring to FIG. 1, master counter 10 is for the purpose of representing the pointer position within the display region using x and y coordinates. It is formed of a dot counter (horizontal coordinate counter) and a raster counter (vertical coordinate counter). The output signal of master counter 10 is sent to latch 13 via scroll means 11, and then it is sent to reverse affine transformer 12 and latch 13, which are provided for bringing about the enlargement, reduction and rotation functions.

If the enlargement, reduction and rotation modes are set to on by selector 14, and if coordinate signal a, which is retained at latch 13, is set to off, coordinate b, which is retained at latch 13, will be output to region determination means 15. Coordinate a is the coordinate that represents the use of the enlargement, reduction and rotation functions. Coordinate b is the coordinate that represents the coordinates of the normal mode, which is the mode when the enlargement, reduction and rotation functions are not used.

Region determination means 15 determines whether the coordinate signal received is within the original image region, which will be described later, or outside of this region. If it is within the original image region, the coordinate signal will be allowed to pass. If it is outside of the original image region, the designated processing will take place. The output signal of region determination means 15 will be input to latch 16. Background attribute table (BAT) address generation means 17 and character generator (CG) address generation means 18 control the address formation for accessing memory means 24. They exchange data with memory means 24 through latches 19, 20, 21 and 22 and memory interface means 23.

If the enlargement, reduction and rotation modes are set to on, data c, which is concerned with the images input through latch 22, will be input to latch 27 through rotator 25 and selector 26. If the enlargement, reduction and rotation modes are set to off, data c will be input to latch 27 through selector 26 only. Register file 30 stores, for example, parameters concerned with control commands and their operations for the aforesaid functions, such as address generation for accessing memory means 24, in which is stored the data required for generating the enlargement, reduction, rotation, region determination, and image data or the data required for generating image data.

Figure 2:
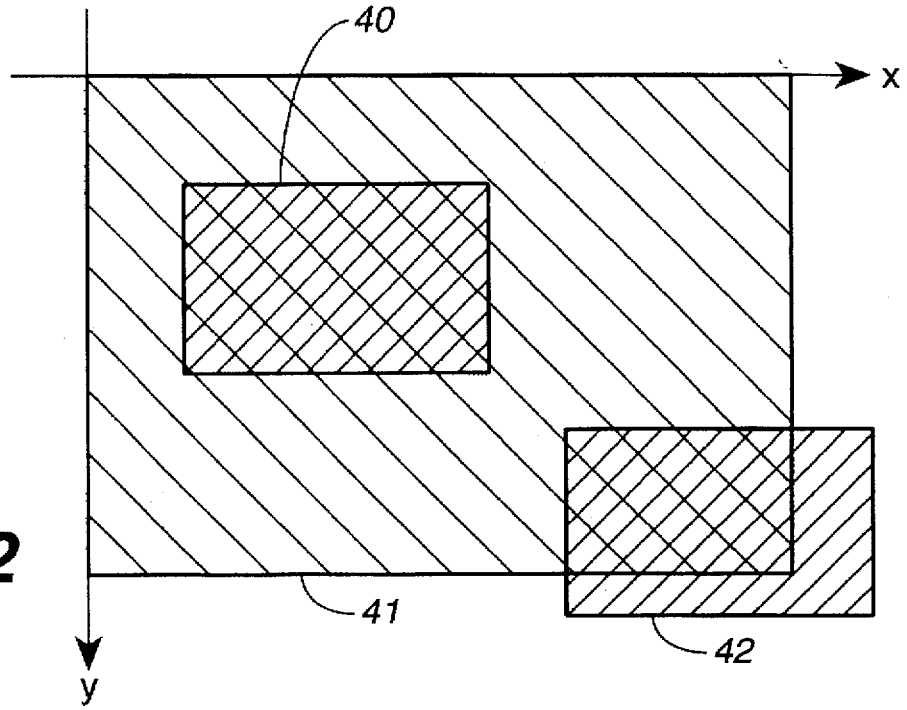
FIG. 2 is drawing that describes the original image region and the display region.

FIG. 2 provides a description of the original image region and the display region. In this drawing, in the region of original image region 41, the designated image is defined. However, outside of this region, the image is not defined. In the case of display region 40, there are times when it will extend outside of the original image region, as in region 42. At such a time, the region outside of the original image region will be processed according to the command set in register file 30.

Figure 3:
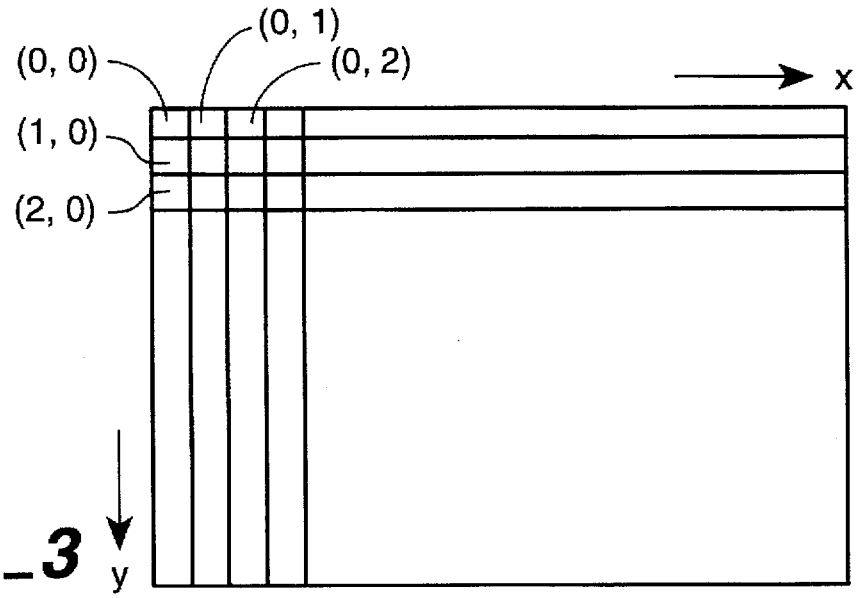
FIG. 3 is a drawing that describes the coordinates within the display region, which is generated by the master counter.

FIG. 3 shows the display region coordinates (x, y) that are generated by the operation of master counter 10 in the display region. The x coordinates are generated by the dot counter. The y coordinates are generated by the raster counter.

FIGS. 4(A)–4(D) illustrate the previously mentioned background attribute table and character generator. The image data, which corresponds to each individual pixel in computer graphics such as TV games and multi-media personal computers, is saved in memory means 24 in the form of CG data. In addition, the CG data is gathered as necessary in units (for example, an 8 pixel by 8 pixel unit) of multiple pixels that have a high level of interrelationship and are stored in the background attribute table.

Figure 4A:
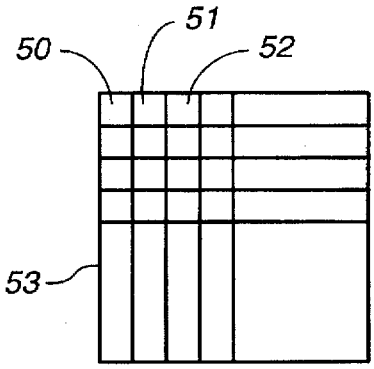
FIG. 4(A) is a drawing that describes the character structure.

As shown in FIG. 4(A), each individual pixel 50, 51, 52, that is expressed as CG data will be put in the form of character 53. Further, as shown in FIG. 4(B), original image 41 is formed by one or more characters 54, 55, 56. CG data CG(50), CG(51), and CG(52), which correspond to respectively to pixel 50, 51 and 52, are stored in memory 24 as shown in FIG. 4(C), for example.

Figure 4C:
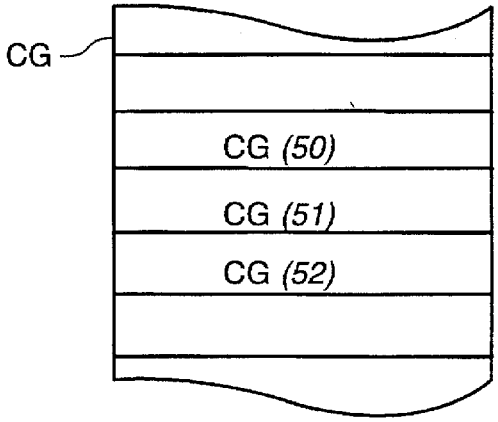
FIG. 4(C) is a drawing that describes the method of storing the CG data.
Figure 4B:
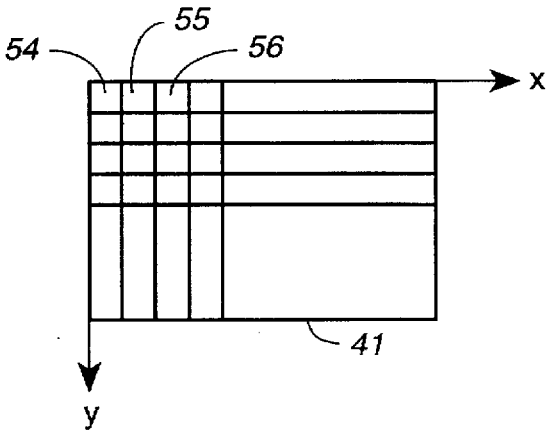
FIG. 4(B) is a drawing that describes the structure of the original image.
Figure 4D:
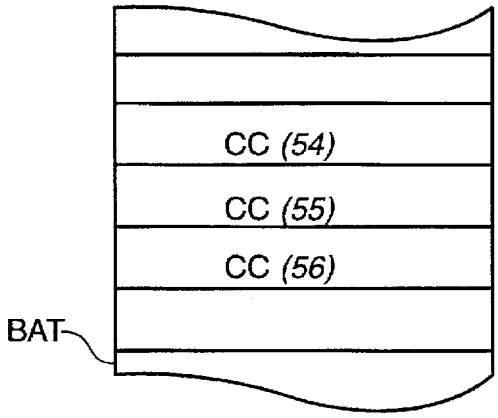
FIG. 4(D) is a drawing that describes the method of storing the character codes.

If the pixel data that belongs to character 53 is stored in contiguous addresses, as shown in FIG. 4(C), it will be good for character unit processing. The symbol that represents each character, 54, 55, 56, shown in FIG. 4 is defined as the character code, and each one will be referred to as CC(54), CC(55) and CC(56), and so on. These character codes are placed in the memory means called BAT, which was mentioned previously, as shown in FIG. 4(D). As described above, whether BAT and CG will be used to express the desired image or whether only CG will be used, will be determined by the circumstances.

In FIG. 1, either a portion of or all of the described hardware is controlled by a microprogram. Microcode memory 28 stores the microprogram. Delay means 29 appropriately delays the content of the microprogram so that it matches its execution cycle (i.e., proper pipeline timing is maintained). The operations of scrolling, enlargement, reduction, rotation, region determination and address generation are each controlled by control signals d, e, f and g based on the microprograms represented by the broken lines. In the first embodiment, the number of background screens handled by the image regeneration device is four.

Scrolling

Figure 5:
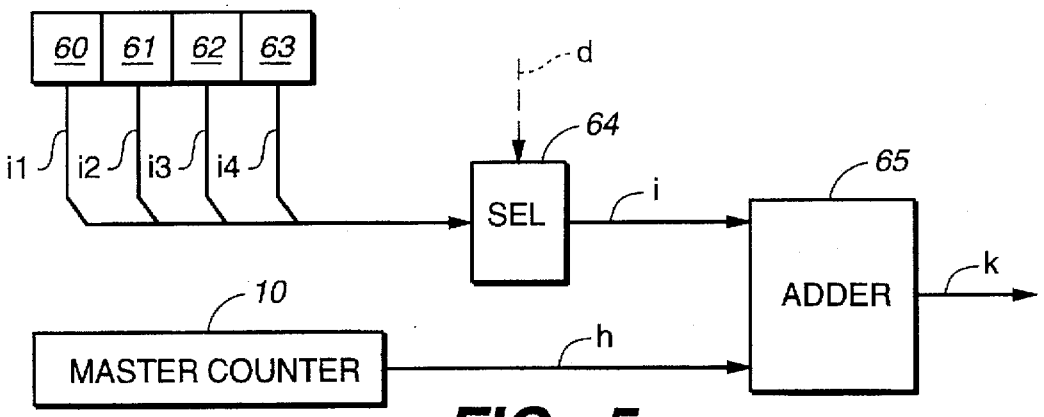
FIG. 5 is a drawing that shows the detailed embodiment of scroll means 11 in FIG. 1.

FIG. 5 shows an example of the detailed configuration of scroll means 11. FIG. 5 shows registers 60, 61, 62 and 63, which are contained in register file 30, in which are stored scroll parameters i1, i2, i3 and i4, which are for the four screens, screen 1, screen 2, screen 3 and screen 4. Selector 64, in response to control signal d, which was generated based on the content of the microprogram, selects one of four scroll parameters, i1, i2, i3 or i4, and makes that scroll parameter i. Coordinate signal h, which was generated by master counter 10, will be added to scroll parameter i by adder 65. Coordinate signal k is obtained as the output of adder 65 which is also the output of scroll means 11.

Enlargement, Reduction, Rotation

Figure 6:
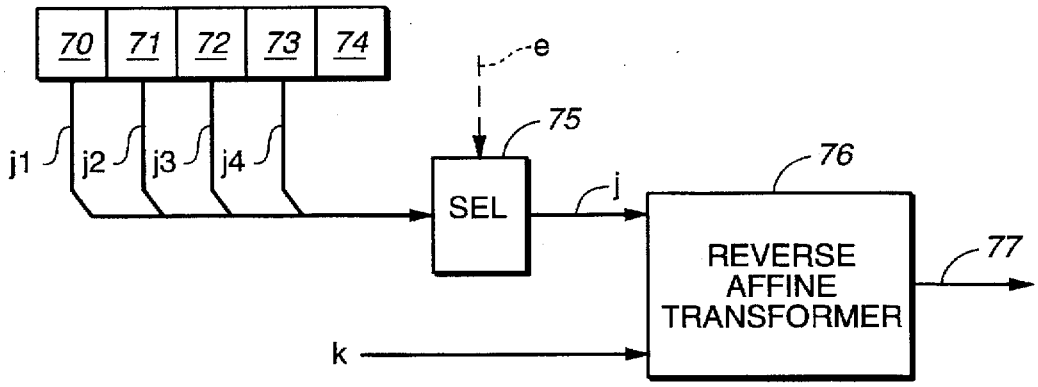
FIG. 6 is a drawing that shows the detailed embodiment of reverse affine transformation means 12 in FIG. 1.

The enlargement, reduction and rotation functions are implemented by means of reverse affine transformation. FIG. 6 shows an example of the detailed configuration of reverse affine transformation means 12. FIG. 6 shows registers 70, 71, 72 and 73, which are contained in register file 30. Register file 30 is shown in FIG. 1, and in it are stored the reverse affine transformation parameters, j1, j2, j3 and j4, which are for the four screens, screen 1, screen 2, screen 3 and screen 4. In register 74 are stored the control codes that control the turning on and off of the enlargement, reduction and rotation modes.

Selector 75 obeys the command of control signal e, which is generated based on the content of the microprogram, which selects one of the four reverse affine transformation parameters, i1, i2, i3 or i4, and which makes that reverse affine transformation parameter j. Coordinate signal k is obtained from scroll means 11 as an input to reverse affine transformer 76. Reverse affine transformer 76 will carry out the reverse affine transformation using parameter j. As indicated above, coordinate signal k, which underwent enlargement, reduction and rotation processing, is obtained as an input to reverse affine transformer 76. If the control code stored in register 74 commands the turn on of the enlargement, reduction and rotation modes, selector 14 will select coordinate signal a. If it commands the turn off of these modes, it will select coordinate signal b.

Region Determination

Figure 7:
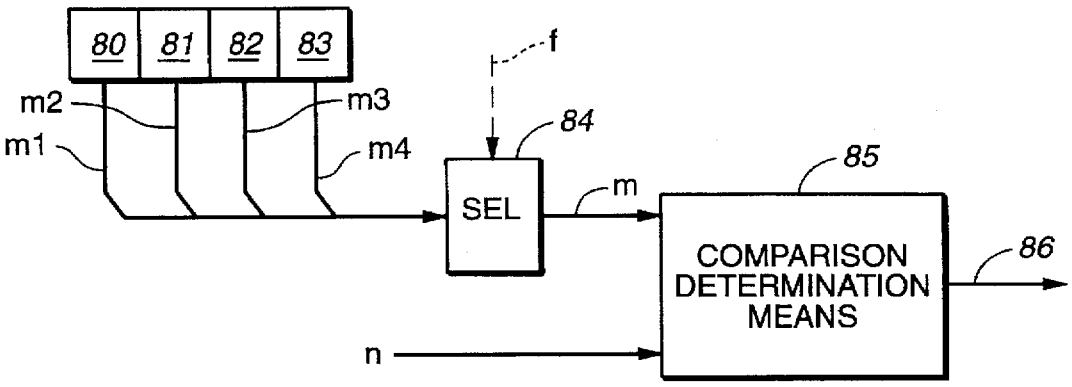
FIG. 7 shows the detailed embodiment of region determination means 15 in FIG. 1.

FIG. 7 shows an example of the detailed configuration of region determination means 15. FIG. 7 shows registers 80, 81, 82 and 83, which are contained in register file 30, in which are stored the original image sizes, m1, m2, m3 and m4, which are for the four screens, screen 1, screen 2, screen 3 and screen 4. Selector 84 obeys the command of control signal f, which is generated based on the content of the microprogram and selects one of the four original image sizes, m1, m2, m3 or m4, and makes that original image size m.

Coordinate signal n, is compared with the original image size by means of the comparison determination means 85 which determines if coordinate signal n is within the region of the original image or outside of that region. Coordinate signal 86 is obtained as the output of comparison determination means 85.

Address Generation

When trying to implement an image regeneration device that has a plurality of background screens and a plurality of display modes, the address generation sequence for accessing memory 24 becomes very complicated.

Figure 8:
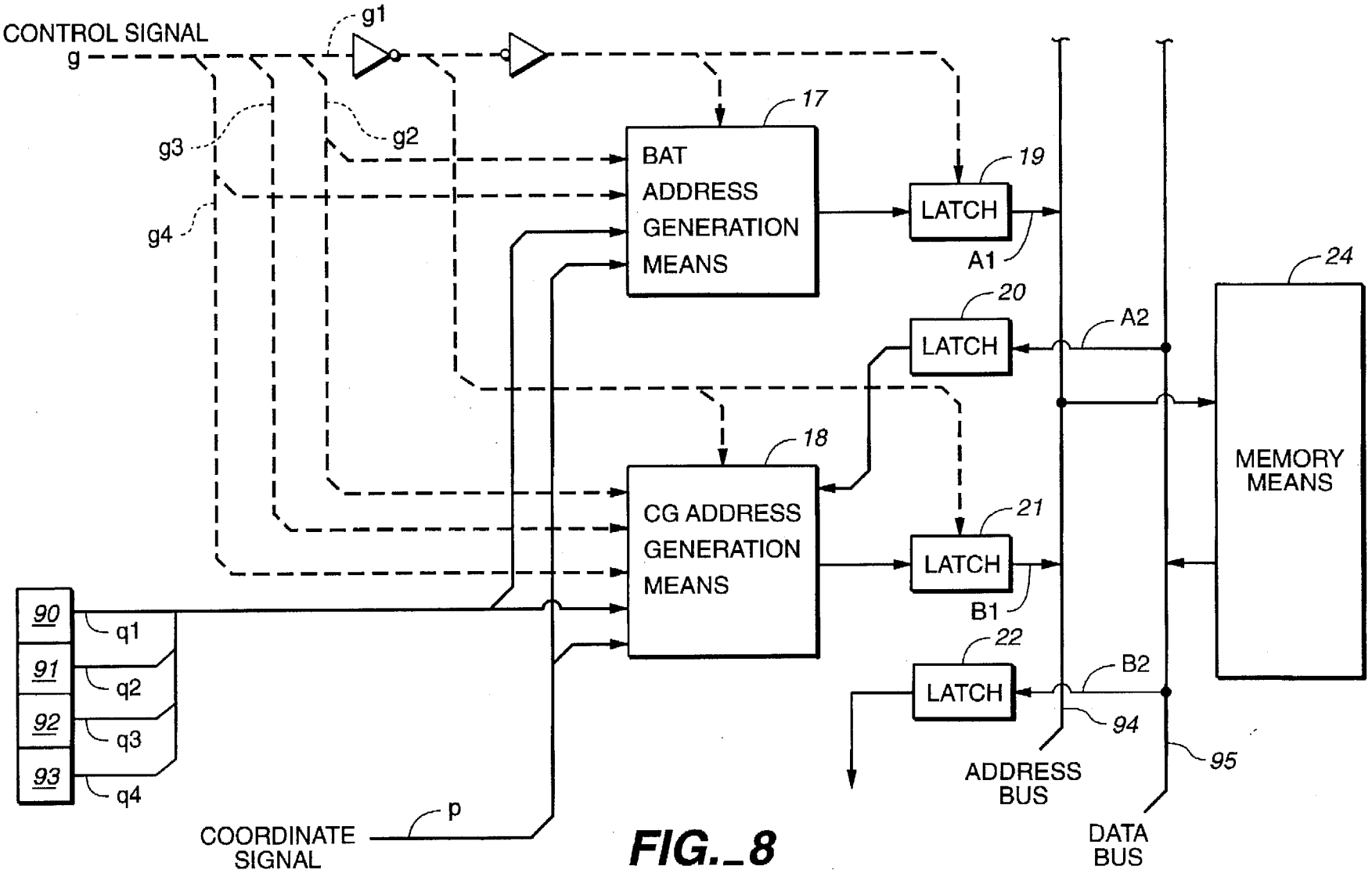
FIG. 8 shows the detailed embodiment of BAT address generation means 17 and CG data address generation means 18 in FIG. 1.

FIG. 8 shows an example of the detailed configuration of BAT address generation means 17, CG data address generation means 18 and the control signal path. Control signal g is generated based on the content of the microprogram. This signal contains control signal g1, which commands whether or not to generate either the BAT address or the CG address, control signal g2, which shows the screen number of the display screen to which the data to be regenerated belongs, control signal g3, which indicates that the enlargement, reduction and rotation mode is turned on or off, and supplementary parameter g4 for calculating addresses.

FIG. 8 also shows registers 90, 91, 92 and 93, which are contained in register file 30. These registers store control signals q1, q2, q3 and q4, which represent the display modes of the four screens, screen 1, screen 2, screen 3 and screen 4. In response to control signal g1, either BAT address generation means 17 or CG data address generation means 18 will enter the active state. In response to control signal g2, one of control signals, q1, q2, q3 or q4 that indicate the control mode will be selected, and this will determine if the enlargement, reduction and rotation modes are turned on or off. Then, while being controlled by the above results, the desired BAT address or CG address will be calculated based on coordinate signal p.

At this point, if the microprogram calls for the regeneration of the images using both BAT and CG, as shown in FIG. 8, first an address will be sent to memory 24 through bus A1, and then data will be received from memory 24 through bus A2. Next, an address will be sent to memory 24 through bus B1, and then data will be received from memory 24 through bus B2. However, if the microprogram calls for the regeneration of images using CG data only, an address will be sent to memory 24 through bus B1 and data will be received from memory 24 through bus B2.

Figures 9, 11:
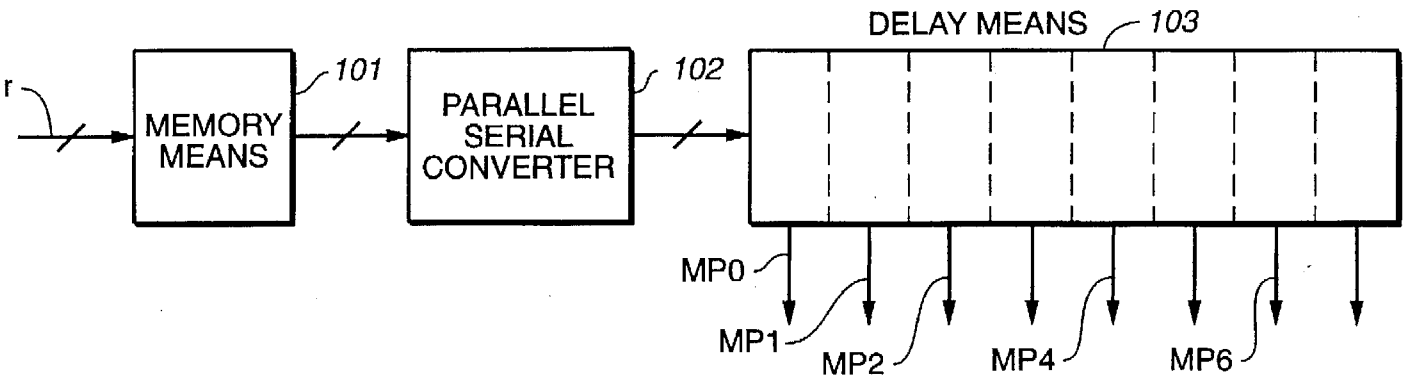
FIG. 9 shows one example of a microprogram.
FIG. 11 shows the first specific example of the means that forms control signals MP0, MP1, MP2, MP3, MP4 and MP6.

The microprogram is such that a designated routine is to be completed within a set cycle. FIG. 9 shows a microprogram example using both BAT and CG in the first screen to obtain the regenerated images and using only CG in the second screen to obtain the regenerated images. Based on the microprogram of FIG. 9, the two-screen image regeneration operation goes through eight cycles, from cycle 0 to cycle 7, to complete one routine.

The image regeneration device in FIG. 1, carries out pipeline operations while being controlled by the microprogram. As shown in FIG. 1, the data read from the coordinate signals or the memory means flows between each block along the solid line arrows. The control signals formed based on the microprogram are supplied to each block along the broken line arrows.

Figure 10:
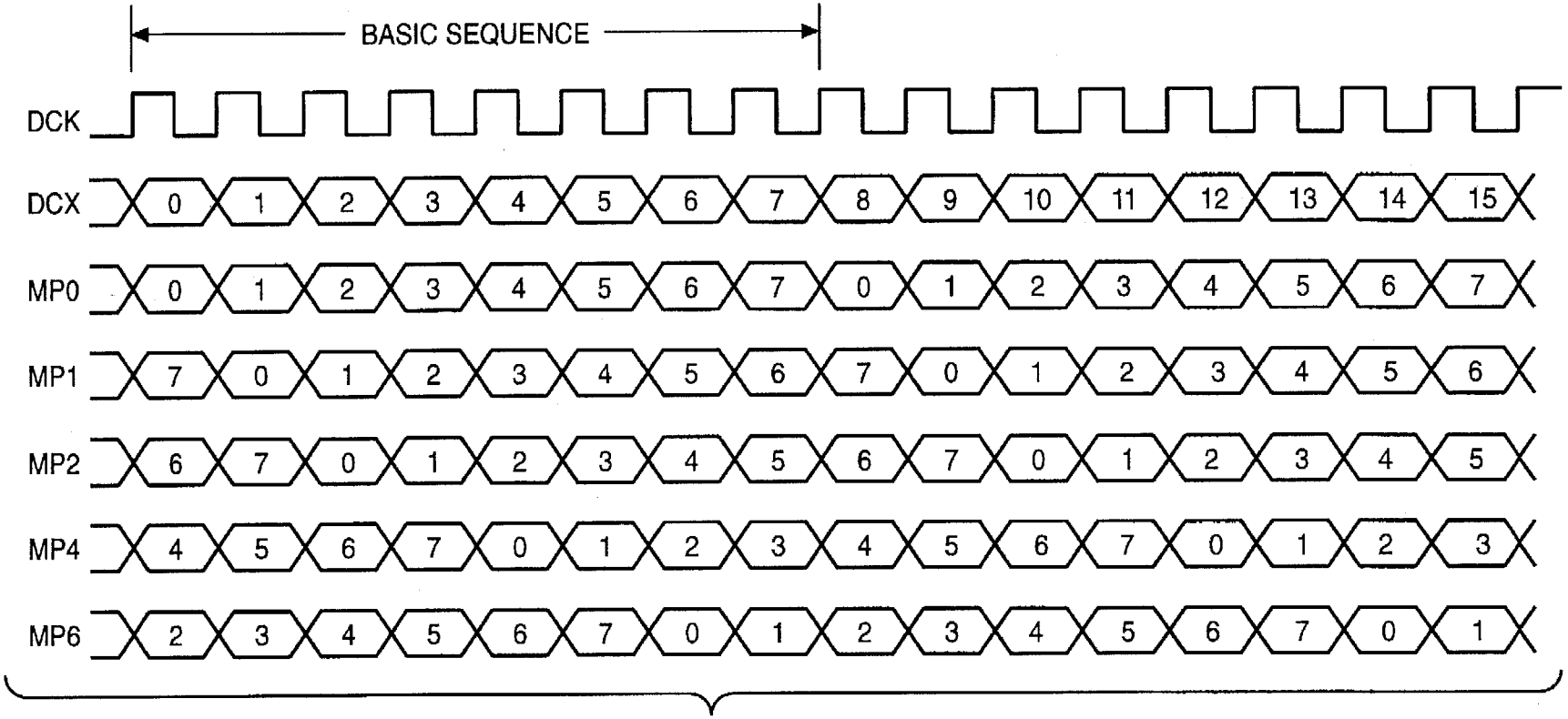
FIG. 10 is a timing chart that describes the flow of the microprogram.

Either the data read from the coordinate signals or the memory means will be delayed by one clock each time they pass through a latch. As a consequence, each circuit block in FIG. 1 will be controlled by control signals MP0, MP1, MP2, MP4 and MP6, which are based on the microprogram shown in FIG. 10. In FIG. 10, DCK is the dot clock, DCX is the count of the dot counter in master counter 10, MP0 is the original signal of the microprogram, and MP1, MP2, MP4 and MP6 are signals that delay the MP0 signal one clock, two clocks, four clocks and six relay clocks, respectively.

Further, the numbers described within signals MP0, MP1, MP2, MP4 and MP6 are the cycle numbers shown in FIG. 9. At this time, as shown in FIG. 1, master counter 10, scroll means 11 and affine transformer 12 will undergo pipeline processing by means of control signal MP0. Latch 13 and selector 14, which is between latch 13 and latch 16, and region determination means 15 will undergo pipeline processing by means of control signal MP1. BAT address generation means 17, which is between latch 16 and latch 19 will undergo pipeline processing by means of control signal MP2. CG address generation means 18, which is between latch 20 and latch 21, will undergo pipeline processing by means of control signal MP4. Rotator 25 and selector 26, which are between latch 22 and latch 27, will undergo pipeline processing by means of control signal MP6.

Next, the means that generates control signals MP0, MP1, MP2, MP4 and MP6 will be described. A first means is shown in FIG. 11. In FIG. 11, microprogram r, which is supplied from the outside, is first written to memory 101 and then transferred to delay means 103 (for example, a shift register) through parallel-serial converter 102. Delay means 103 has a data width (number of bits) equivalent to that of the microprogram r data width and has a number of delays that is equivalent to the number of cycles (for example, the aforementioned eight cycles) for microprogram r. Each output of delay means 103 provides the control signals, MP0, MP1, MP2, MP4 and MP6, described above.

Figure 12:
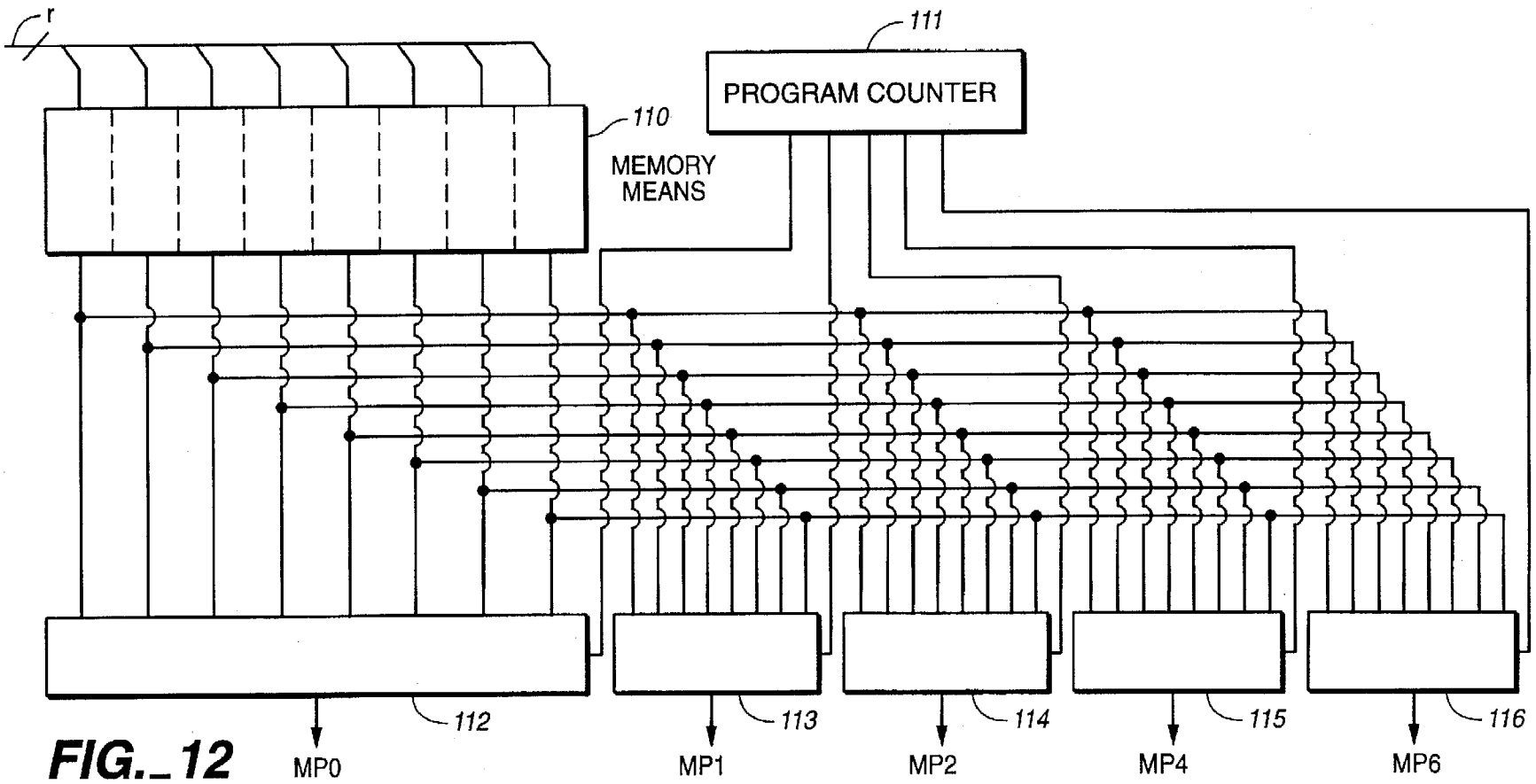
FIG. 12 shows the second specific example of the means that forms control signals MP0, MP1, MP2, MP3, MP4 and MP6.

A second means is shown in FIG. 12. In FIG. 12, microprogram r is first written to memory 110. Program counter 111 indicates the current state in the basic sequence mentioned in FIG. 10. A microprogram with a cycle sequence that corresponds to that state is selected with selectors 112, 113, 114, 115 and 116 and output takes place to each block in FIG. 1 as control signals MP0, MP1, MP2, MP4 and MP6. Here, program counter 111 and selectors 112, 113, 114, 115 and 116 function as a delay means.

Figure 13:
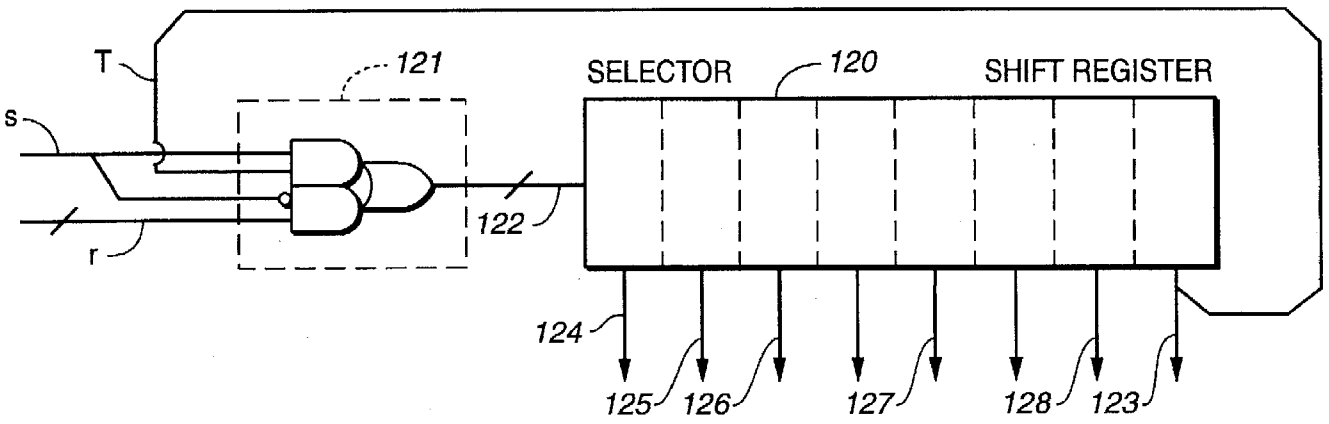
FIG. 13 shows the third specific example of the means that forms control signals MP0, MP1, MP2, MP3, MP4 and MP6.

A third means is shown in FIG. 13. In FIG. 13, final step output pin 123 of shift register 120, which has a data width (number of bits) equal to the data width of microprogram r and has delay steps (8 cycles in the aforesaid example) equal to the number of cycles of microprogram r is connected in a ring shape to input pin 122 of shift register 120 through selector 121. Control signal s is the signal that controls the writing and retention to shift register 120 of microprogram r. If s=0, microprogram r is written to shift register 120. If s=1, the final step output signal of shift register 120 will return to input pin 122 of shift register 120. Shift register outputs, 124, 125, 126, 127 and 128, will provide previously-described control signals MP0, MP1, MP2, MP4 and MP6. In the case of this example, shift register 120 plays the roles of both memory means and delay means.

In this way, the pipeline operation is implemented by controlling each section with signals that delay the microprogram, which allows high-speed processing as well as allows a high level of processing by simply offering hardware of a small size at each step. Complicated hardware for sequence control is not required.

Second Embodiment - Structure

Figure 14:
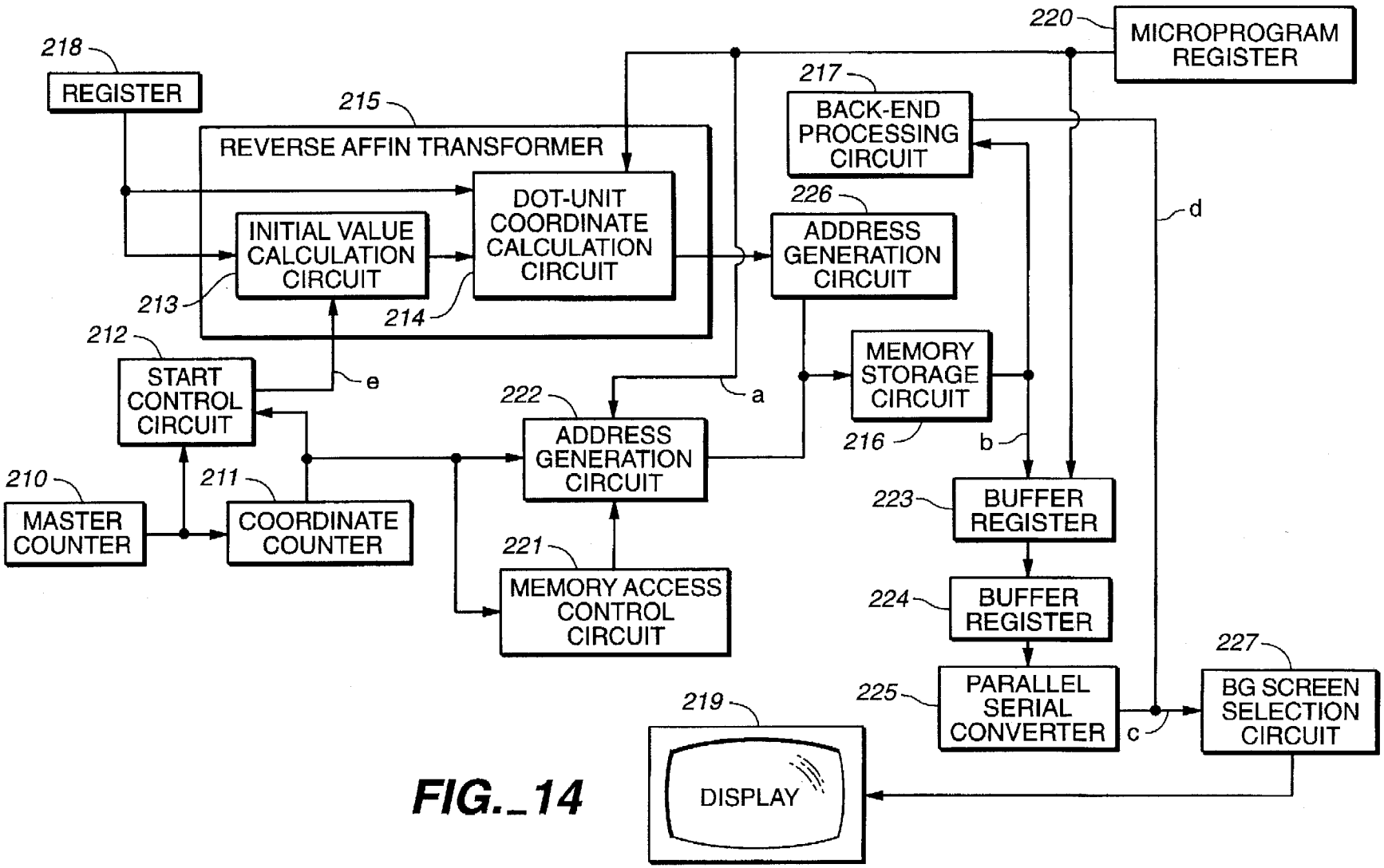
FIG. 14 is a block diagram that describes the structure of the second embodiment of this invention.

The image regeneration device of FIG. 14 can handle the enlargement, reduction and rotation modes and the normal mode. It is equipped with an address generation function for accessing the memory where either image data or the data required for generating the image data is stored.

Normal mode means the display mode that does not include enlargement, reduction and rotation processing. The image regeneration device can display a plurality of screens in a plurality of display modes. Either a portion or all of the hardware that implement these functions operate according to microprograms (i.e., microcoded control information).

Figure 15:
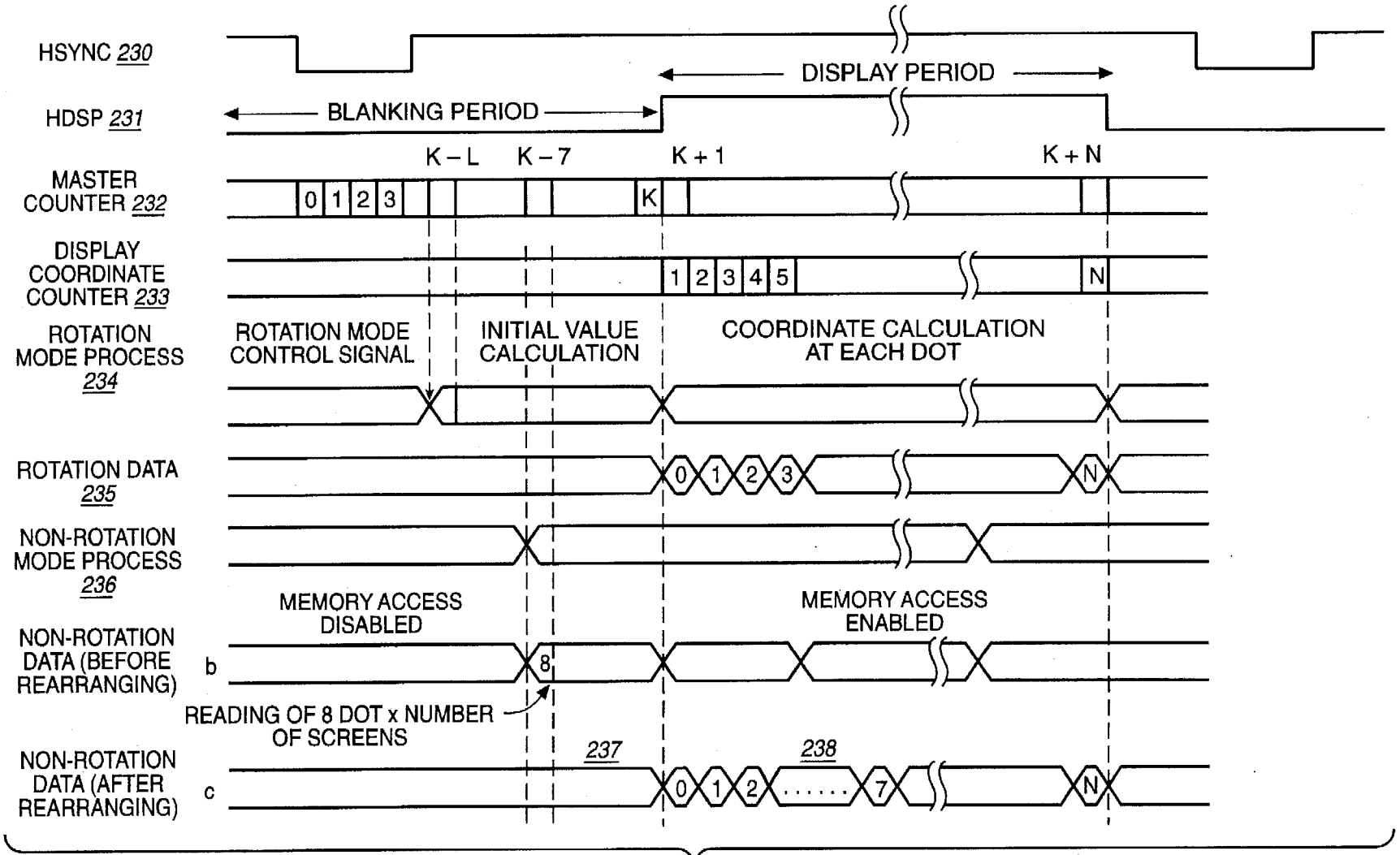
FIG. 15 is a timing chart that describes the operation of the second embodiment of this invention.

The second embodiment is described using FIGS. 14–15. The present invention has a first circuit system and a second circuit system. As shown in FIG. 14, the first circuit system has a memory access control circuit 221, an address generation circuit 222, a memory 216, a buffer register 223, a buffer register 224, parallel-serial converter 225 and BG screen selection circuit 227. The second circuit system has start control circuit 212, reverse affine transformer 215, address generation circuit 226, memory means 216, back end processing circuit 217 and BG screen selection circuit 227. Reverse affine transformer 215 includes an initial value computation circuit 213 and a dot-unit coordinate computation circuit 214. It is connected to register 218, which stores the parameters for enlargement, reduction and rotation. The first circuit system controls the image regeneration of the normal mode, and the second circuit system controls the enlargement, reduction and rotation modes. A portion of all of the circuit blocks of the first circuit system and second circuit system are connected to microprogram register 220, where the microprogram is stored.

Master counter 210 is the counter that counts the number of vertical rasters that use the vertical synchronous signal as a reference and counts the number of horizontal dots that use the horizontal synchronous signal as a reference. In addition, coordinate counter 211 is for representing the position within the display region with coordinates (x, y) and is made up of the dot counter (horizontal coordinate counter) and the raster counter (vertical coordinate counter).

Second Embodiment - Operation

In this embodiment, the case in which one character unit is eight pixels for both horizontal and vertical will be described. A character is a collection of pixels with a high level of interrelationship. For example, characters such as those of a word processing computer are applicable in this case. Even in a TV game, the image data that corresponds to each individual pixel is stored in the memory means as CG data. If necessary, this CG data will be gathered as a unit (for example, both horizontal and vertical pixel units) of many pixels (said pixels having a high level of interrelationship) and stored in the background attributes table (BAT).

Figure 16:
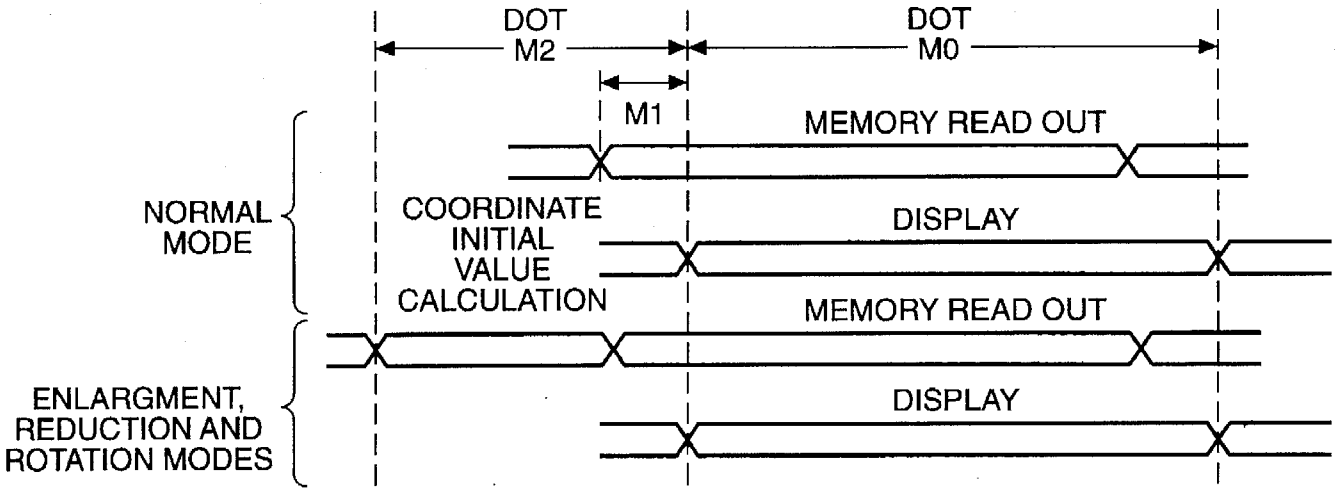
FIG. 16 shows the operational timing of the normal mode and the enlargement, reduction and rotation modes.

As shown in FIG. 16, both the normal mode and the enlargement, reduction and rotation modes have a M0 dot display time period. The pre-processing of the image data in the normal mode requires the M1 dot time period. The pre-processing of the image data in the enlargement, reduction and rotation modes requires the M2 dot time period. In order to match the display timing in the two modes mentioned above, it is necessary for the normal mode to start the memory access at least M1 dots earlier than the display start.

When in the enlargement, reduction and rotation modes, the calculation of the initial value of the coordinates must start at least M2 dots earlier than the display start. At the end of the initial value calculation, it is necessary to carry out a memory access. By carrying out such a timing setting, it is possible to match the display timing of both the normal mode and the enlargement, reduction and rotation modes.

In FIG. 15, waveform HSYNC 230 shows a horizontal synchronizing signal and waveform HDSP 231 shows a display period of display device 219. Master counter 210 starts the dot count at the fall of HSYNC, and the image display from the K+1 dot to the K+N dot takes place in display 219. The K+1 dot of master counter 210 is the first dot of coordinate counter 211. The K+N dot of master counter 210 is the Nth dot of coordinate counter 211.

In FIG. 14, when normal mode display is selected, memory access control circuit 221 issues a command when the count of master counter 210 is 8 dots (one character) before the start of display. That is, it will command address generation circuit 222 to start memory access when K–7 has been reached. Memory 216 is accessed as shown by waveform 231 of FIG. 15. Address generation circuit 222 will obey control signal a, which is based on the microcode stored in microprogram register 220, and generate the address. As a result, normal mode image data b will be read at the timing indicated by waveform 237 in FIG. 15.

The content of the microcode is composed of instructions concerning things such as what background screen to use out of the plurality of background screens and what color mode to use out of the many color modes and whether to use the enlargement, reduction and rotation modes. The basic sequence that executes the microcode is set to character units. In the case of this embodiment, the microcode is described so that one character, that is, eight bits, of image data is read in one basic sequence.

Figures 19A, 19B:
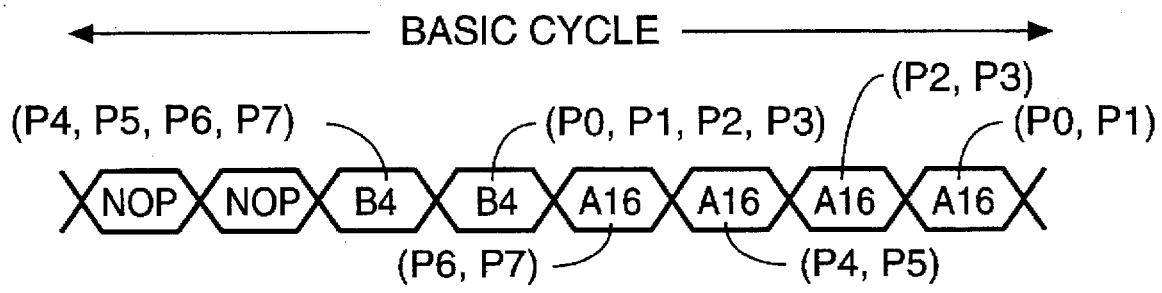
FIG. 19(A) shows an example of a microprogram description.
FIG. 19(B) describes the image data arrangement immediate after it has been read by the memory means.

An example of a microprogram is shown in FIG. 19(A). Image data b, read from memory 216, is arranged in a time sequence that is different from the sequence displayed on display 219, for example, as indicated in FIG. 19(B). Referring to FIG. 14, first buffer register 223 has been provided for the purpose of rearranging image data b. By passing through first buffer register 223 and second buffer register 224 and parallel-serial converter 225, image data b will be converted into image signal c, which has been rearranged in display sequence. As is clear from FIG. 15, optional component data 237, which is equivalent to one character of image data b, will be delayed at least eight bits, that is, one character, and be converted into component data 238, which is equivalent to one character of image data c.

Referring to FIGS. 14–15, when enlargement, reduction and rotation modes are selected, start control circuit 212 will command the reverse affine transformer 215 to start the initial value calculation of the reverse affine transformation when the count of master counter 210 reaches K–L, as shown in waveform 234. The time required for the initial value calculation of the reverse affine transformation will be a maximum L+1 dot clocks.

Next, start control circuit 212 commands reverse affine transformer 215 to start the per-dot coordinate calculations based on the results of the initial value calculation when the count of master counter 210 has reached K+1. As a result, an address will be generated at first address generation circuit 226, based on coordinates that underwent reverse affine transformation. Image data d of the enlargement, reduction and rotation modes from memory 216 is read and displayed on display 219 at the timing indicated by waveform 235.

The start of the initial value calculation takes place by providing control signal e to initial value calculation circuit 213 from start control circuit 212. Count K–L of the start of the initial value calculation will be determined so that the display timing of image data d of the enlargement, reduction and rotation modes matches the display timing of image data c of the normal mode based on the time required for the reverse affine initial value calculation to become equivalent to L+1 dot clocks.

Below, detailed descriptions of the operation of reverse affine transformer 215 used in the enlargement, reduction and rotation modes, initial value calculation circuit 215, and per-dot coordinate calculation circuit 214 are given.

Reverse affine transformer 215 is the hardware that executes the reverse affine transformation. It obtains new coordinates ($X_2$, $Y_2$) by converting the coordinates shown in Eqs. 1 and 2 relative to the original coordinates.

$$X_2=A(X_1-X_C)+B(Y_1-Y_C)+X_C \quad \text{Eq. 1}$$

$$Y_2=C(X_1-X_C)+D(Y_1-Y_C)+Y_C \quad \text{Eq. 2}$$

The image data that corresponds to the new coordinates ($X_2$, $Y_2$) obtained in this manner are read from memory 216. Displaying the content of this image data in the position of the original coordinates ($X_1$, $Y_1$), brings about the enlargement, reduction and rotation of the original coordinate system.

Developing Eqs. 1 and 2, leads to obtaining Eqs. 3 and 4.

$$X_2=AX_1+BY_1+(1-A)X_C-BY_C \quad \text{Eq. 3}$$

$$Y_2=CX_1+DY_1-CX_C+(1-D)Y_C \quad \text{Eq. 4}$$

In the enlargement, reduction and rotation displays from the reverse affine transformation that took place in the technology of the prior art, the calculation of Eqs. 3 and 4 take place one time for one dot. However, based on the method of the prior art, it is necessary to have four multiplications and four additions and/or subtractions for one dot. In order to perform this with the current and the near-future integrated circuit technology, a significant sacrifice in chip area will have to be made by requiring a large amount of hardware.

For this reason, in the present invention, the calculation of initial values $X_I$ and $Y_I$ shown in Eqs. 5 and 6 in the calculation of Eqs. 3 and 4, are executed during the horizontal blanking period. For each dot during the time of the display immediately after that, there is only the addition of the constants $X_D$ and $Y_D$, which are indicated by Eqs. 7 and 8. Thus, the original coordinate $X_I$ will increase one increment at a time, from $X_I$=0 to $X_I$=N, during the display period.

$$X_I=BY_I+(1+A)X_C-BY_C \quad \text{Eq. 5}$$

$$Y_I=DY_ICX_C=(1-D)Y_C \quad \text{Eq. 6}$$

$$XD=A \quad \text{Eq. 7}$$

$$YD=C \quad \text{Eq. 8}$$

In addition, the calculation of initial values $X_I'$ and $Y_I'$ shown in Eqs. 9 and 10, will be executed during the vertical blanking period. Immediately afterward, the addition of constants $X_D'$ and $Y_D'$, shown in Eqs. 11 and 12 for each scan line during the display period, take place. Even if the addition of constants $X_D$ and $Y_D$, which are indicated by Eqs. 7 and 8 for each dot, the same result will be obtained.

$$X_I'=(1-A)X_C-BY_C \quad \text{Eq. 8}$$

$$Y_I'=CX_C+(1-D)Y_C \quad \text{Eq. 9}$$

$$X_D'=B \quad \text{Eq. 10}$$

$$Y_D'=D \quad \text{Eq. 11}$$

The block that executes the calculation of the above initial values, $X_I$, $Y_I$, $X_I'$ and $Y_I'$, is initial value calculation circuit 213. The block that executes the calculation of the above constants, $X_D$, $Y_D$, $X_D'$ and $Y_D'$, is the dot-unit coordinate calculation circuit 214.

First buffer register 223, which has been provided with the objective of rearranging image data b of FIG. 14 to the display sequence, second buffer register 224, which has been provided with the objective of controlling the delay time, and parallel-serial converter 225 will be described using a number of examples.

A description will be given about the types and structure of the image data, about an example of the microprogram description and about the type of image data stored in memory circuit 216 of FIG. 14. For the convenience of the description, the examples of the image data conditions of the image data supported by the image regeneration device of this invention will be as follows:

1) The color modes that can be displayed is of three types, 4 colors (2 bits), 16 colors (4 bits) and 256 colors (8 bits).

2) The number of background screens is two, screen A and screen B.

3) The data width of the image data that is stored by memory 216 and the width of the data bus for data transfer will be eight bits.

4) When the image data is handled in character units, its size will be eight pixels, for both horizontal and vertical.

Figures 17, 21:
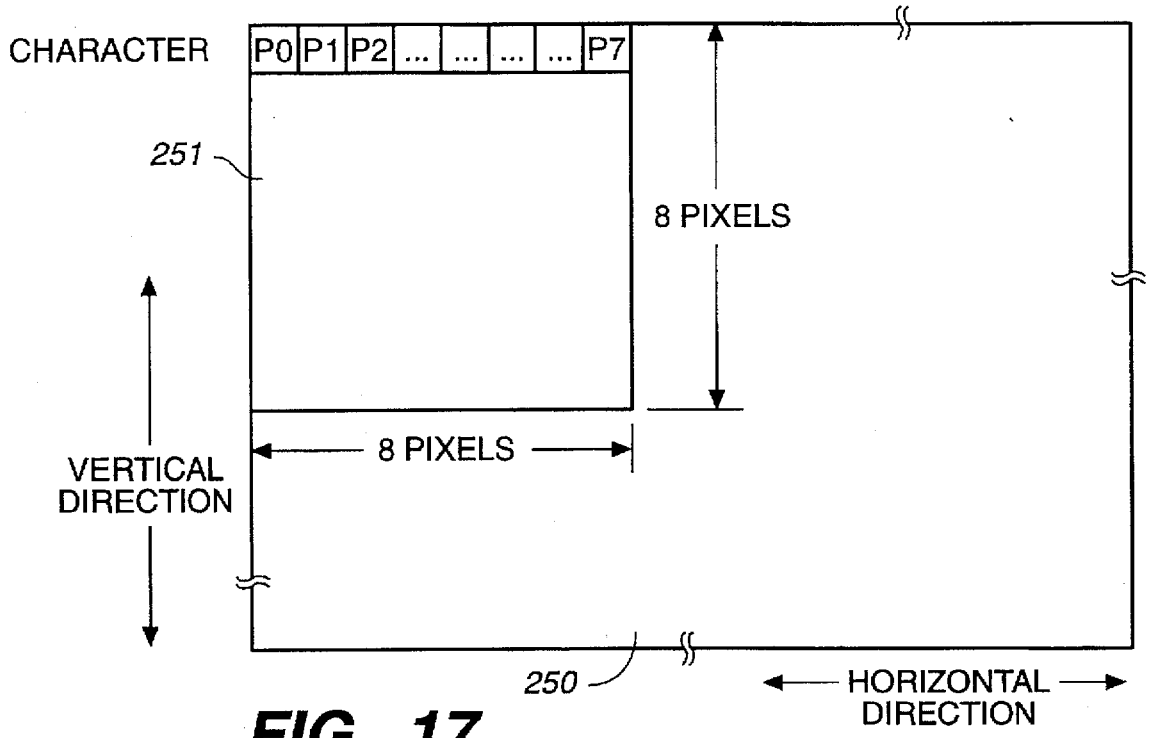
FIG. 17 describes the relationship between characters and pixels.
FIG. 21 shows color mode combinations that can be displayed.

FIG. 17 shows the structure of the aforesaid characters. In this drawing, among the optional characters 251 within screens 250, there are eight each horizontally and vertically, respectively. There is a total of 64 pixels as composition elements. In the following description, the pixels on the optional horizontal line in the aforesaid characters will be called P0, P1, P2 . . . , P6 and P7.

Figure 18A:
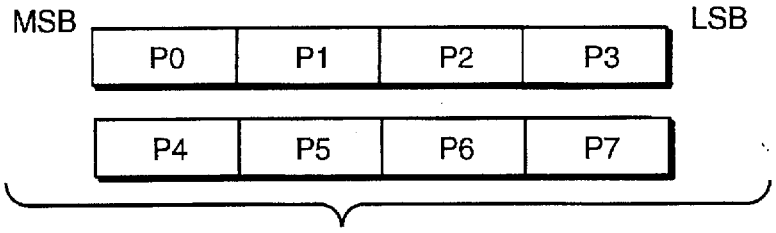
FIGS. 18(A)–(C) describe the data structure when the various color mode image data are stored in the memory circuit.
Figure 18B:
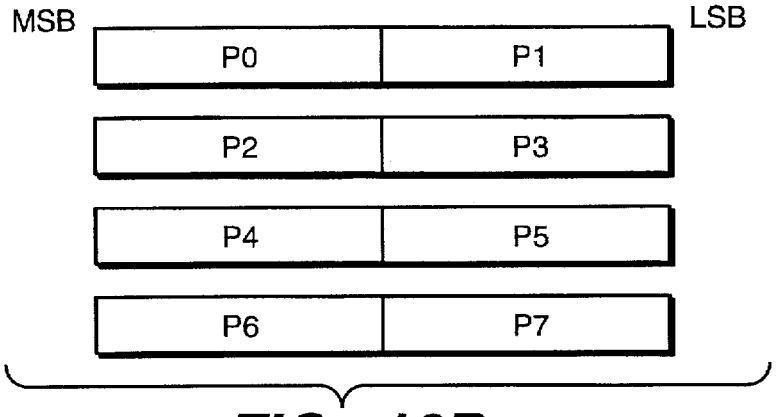
Figure 18C:
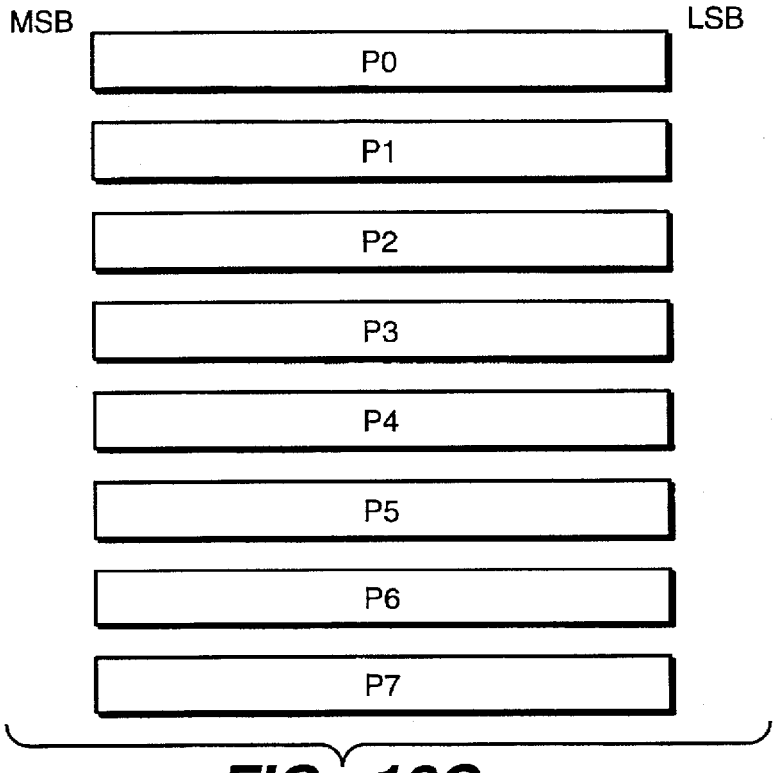

FIGS. 18(A)–(C) show the correspondence between the color modes that can be displayed and the structure of the image data, and also indicate the type of storage when the image data of the respective color modes are stored in memory 216. One word of memory 216 is eight bits. FIG. 18(A) has a four-color mode image data structure. Two-bits of data for each pixel are arranged such that there are P0, P1, P2, P3, to amount to eight pixels (P0, P1, P2, P3, P4, P5, P6 and P7) with two words. Similarly, FIG. 18(B) shows a 16-color mode image data structure. It is arranged in 4 bits of data per pixel, like that of P0 and P1. Four words becomes 8 pixels of data (P0/P1; P2/P3; P4/P5; and P6/P7). FIG. 18(C) is the 256-color mode, which is formed of 8 bits per pixel, and therefore eight words are required for the eight pixels (P0/P1/P2/P3/P4/P5/P6/P7).

One of the characteristics of this invention is that the number of bits per word of the memory circuit becomes the common multiple of the data word length per pixel of the multiple color modes, which brings about the advantage that the capacity of the memory circuit can be used efficiently.

FIG. 19(A) shows the description of the microprogram. One cycle of the microprogram is equal to one dot clock. In addition, stipulating the number of cycles contained in the basic cycle of the microprogram in integer multiples of the number of horizontal pixels of characters 251 is extremely effective. It is an example that regenerates the normal 16-color mode on screen A and the normal 4-color mode on screen B of the two background screen examples of the description. NOP means no operation, that is, memory 216 is not accessed at this time.

FIG. 19(B) shows image data h, which was read from memory 216 according to the microprogram shown in FIG. 19(A). What is clear from FIG. 19(B) is that image data h, right after being read from memory 216, has two screens of data that are arranged in a sequence that is completely different from that of the display sequence. Moreover, even looking at the bit arrangement, the arrangement is completely different from the display type.

Figure 20:
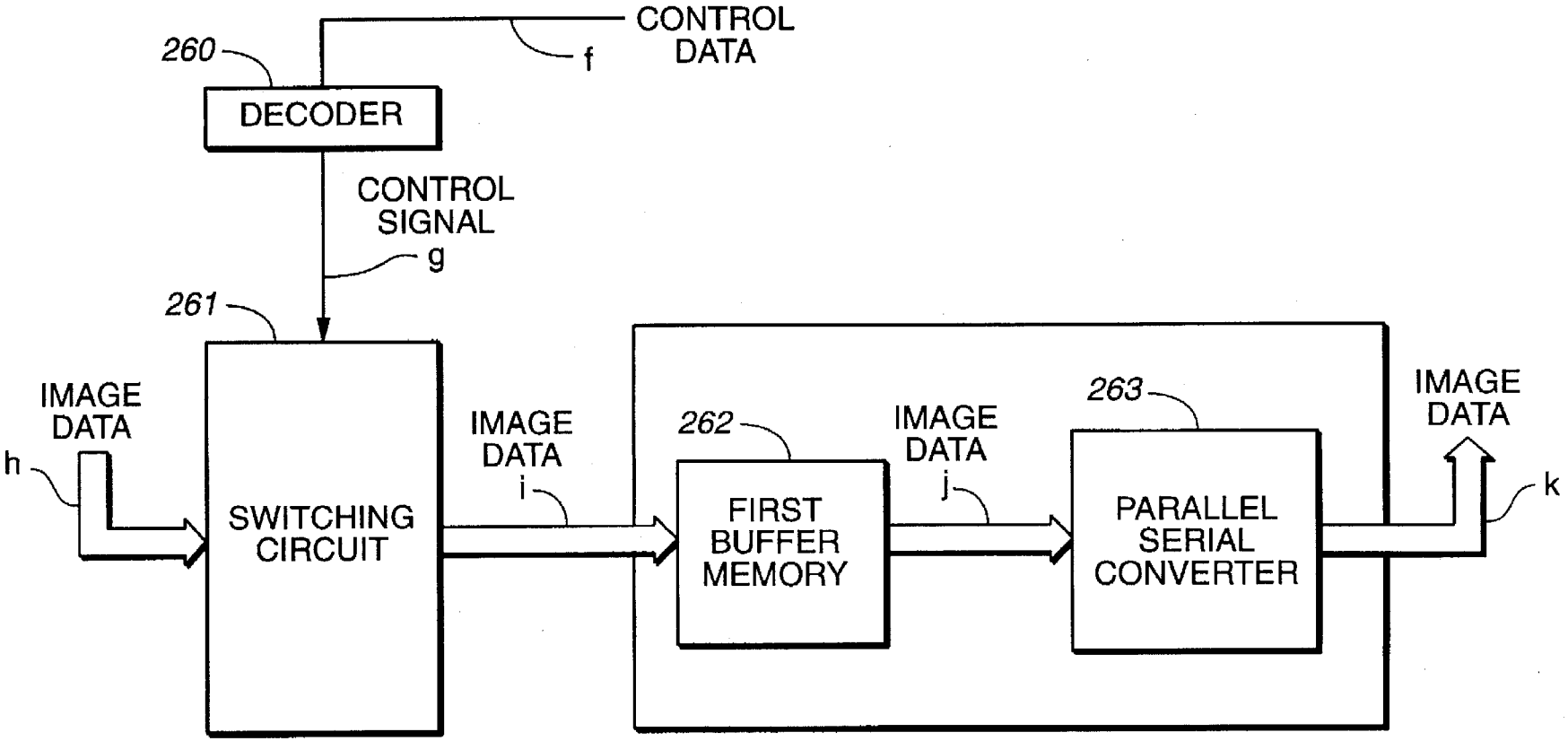
FIG. 20 is a block diagram that describes one example of the word-unit/dot-unit data converter.

FIG. 20 shows a circuit means for rearranging the image data read from memory 216 into the appropriate display sequence. In the following, the circuit means for rearranging the image data in display sequence is called the word-unit/dot-unit data converter. In FIG. 20, the word-unit/dot-unit data converter is composed of decoder 260, switching circuit 261, first buffer memory 262, and parallel-serial converter circuit 263. In decoder 260, control data f from a circuit block such as microprogram register 220 of FIG. 14 is input. In switching circuit 261, decoded control signal g from decoder 260 is input, and image data h from memory 216 is input.

Here, control data f contains data such as the following:

1) combination data between the color mode to be displayed and the background image screen; and 2) which word of data of the same background image screen is the data that arrived during one basic cycle of the microprogram.

Data i, which already has been switched, is input to first memory buffer 262. In addition, output image data j of rearranged buffer memory 262 is input to parallel-serial converter 263. Image data k, which has been rearranged into the display sequence, is output from parallel-serial converter 263.

Word-Unit/Dot-Unit Data Converter

In this embodiment, because of the restrictions that the color modes that can be displayed are of three types (i.e., 4-color, 16-color and 256-color modes); the two background image screens; the one-word, eight-bit data width that memory 216 stores, and the basic cycle of the microprogram is eight cycles, the possible displays of color mode combinations amount to six, as shown in FIG. 21.

Figure 22:
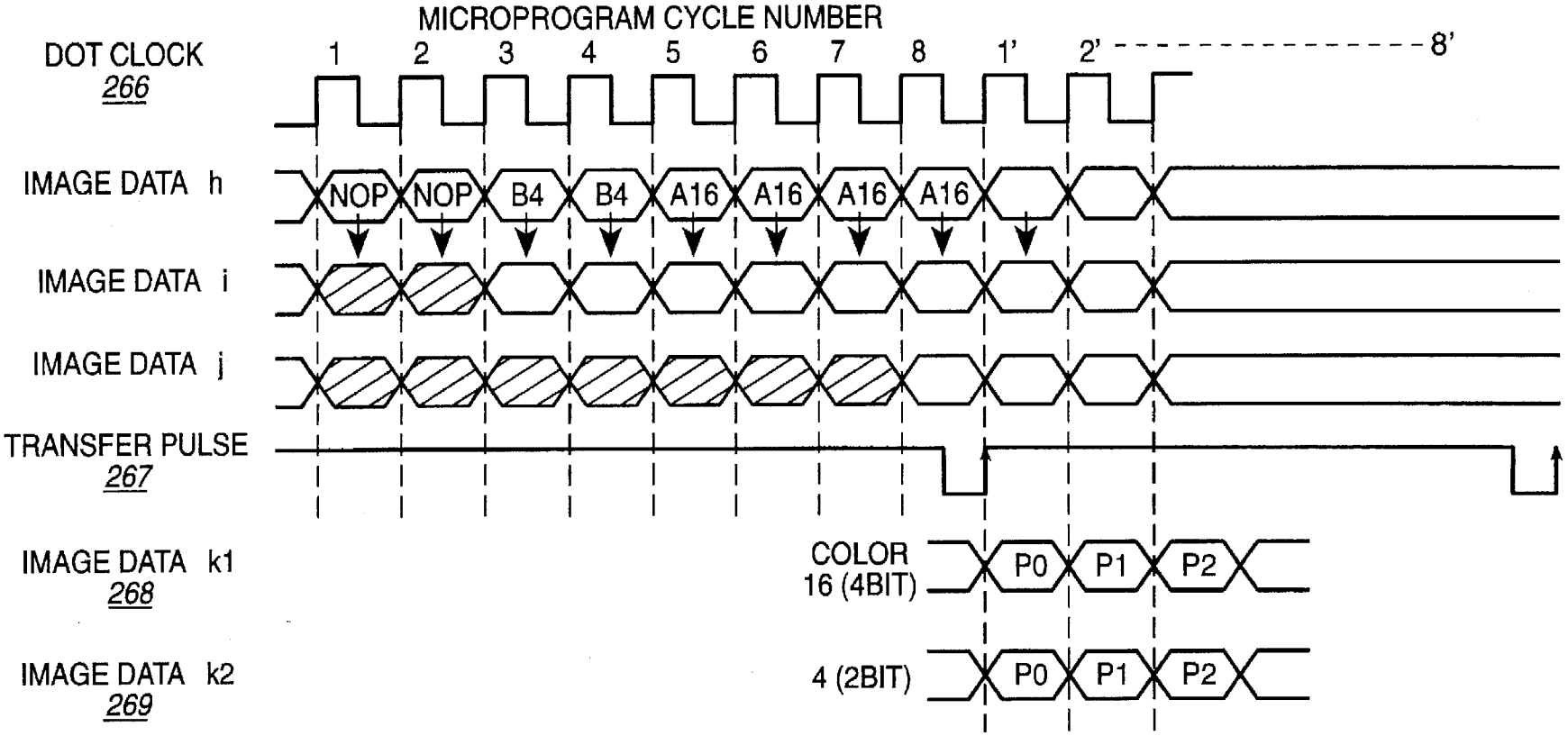
FIG. 22 shows the signal timing of each section in the word-unit/dot-unit data converter of FIG. 20.

FIG. 22 is a timing chart of the signals from each section of the word-unit/dot-unit data converter of FIG. 20. The word-unit/dot-unit data converter rearranges the image data h it receives into the display sequence by carrying out the following operations. Decoder 260 deciphers the control data f it receives and generates control signal g in order to perform the rearrangement operations for the image data using switching circuit 261. Switching circuit 261 switches the 8-bit image data h under control of control signal g. After the data has been converted to image data i, the circuit will write image data i to the designated address of first buffer memory 262. After this write operation has been completed, first buffer memory 262 will transfer all of the eight pixels of image data j, which were read from first buffer memory 262 itself, to parallel-serial converter 263.

The total transfer of image data j will take place one at a time with each one basic cycle (an 8-dot clock in this embodiment) of the microprogram in synchronization with the transfer pulses. In the case of a 2-screen display, image data that correspond to two background image screens, A and B, will be contained at the same time in image data j. In addition, the data width of image data j will be a maximum of 64 bits (8 bits by 8 bits).

When a normal 16 colors are displayed on screen A and a normal four colors are displayed on screen B, the data width of the image data is 8 dots by 4 bits plus 8 dots by 2 bits, for a total of 48 bits. Parallel-serial converter 263 will output the image data j it receives in display sequence as dot-it image data k in synchronization with the dot clock 266. The data width of image data k is 4 bits plus 2 bits, for a total of six bits, when displaying a normal 16 colors on screen A and a normal four colors on screen B. Parallel-serial converter 263 is formed of a parallel-input-serial-output-type shift register.

Figure 23A:
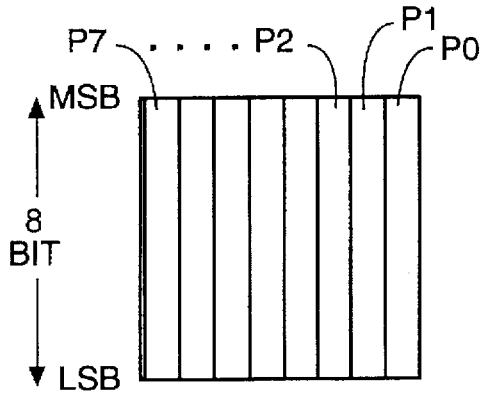
FIGS. 23(A)–(F) show data that has been rearranged by the word-unit/dot-unit data converter.
Figure 23D:
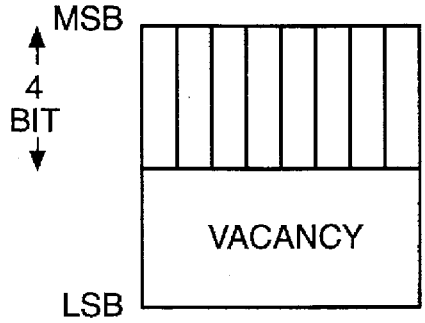
Figure 23B:
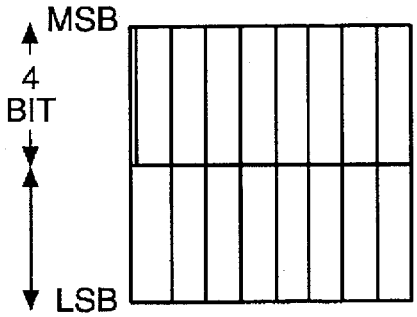
Figure 23E:
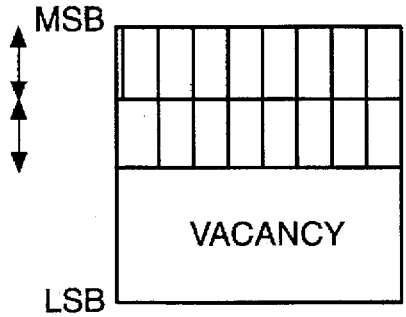
Figure 23C:
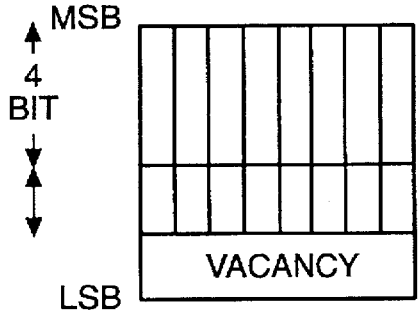
Figure 23F:
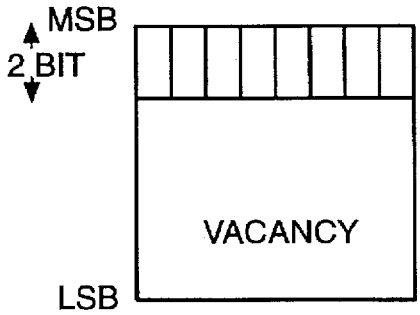

The rearranged results for the combinations in FIG. 21 are illustrated in FIGS. 23(A)–(F). FIG. 23(A) shows the case of one 256 color screen. FIG. 23(B) shows the case of two 16 color screens. FIG. 23(C) shows the case of one 16 color screen and one four color screen. FIG. 23(D) shows the case of one 16 colors screen. FIG. 23(E) shows the case of two four color screens. FIG. 23(F) shows the case of one four color screen.

The areas with the bold lines in FIGS. 23(A), (B) and (E) show the one-word unit data before it was rearranged. As shown in FIG. 18, when there are 256 colors on one screen, one-word unit data before it is rearranged will be output as is as word-unit data, as shown in FIG. 23(A). In addition, as shown in FIG. 18(B), in the case of 16 colors and two screens, for example, P6 and P7, which were read in word units, are divided into two and combined with the P6 and P7 of another screen and is rearranged as shown in FIG. 23 (B).

In the case of four colors and two screens, as shown in FIG. 18(A), for example, P4, P5, P6 and P7, which are read in word units, will be isolated and combined with the P4, P5, P6 and P7 of another screen and rearranged as shown in FIG. 23(E). The area not used at this time will be empty.

FIG. 22 is a timing chart for image data k, which has undergone the rearrangement operation by the word-unit/dot-unit data converter. Image data k1 and k2, shown in this drawing, are component data of image data k, which is image data regenerated according to the microprogram illustrated in FIG. 19(A). Image data k1 is a 16-color image signal of screen A with a width of four bits. Image data k2 is a 4-color image signal of screen B with a width of two bits. One pixel of image data is output per one cycle of dot clock 266.

Figure 24:
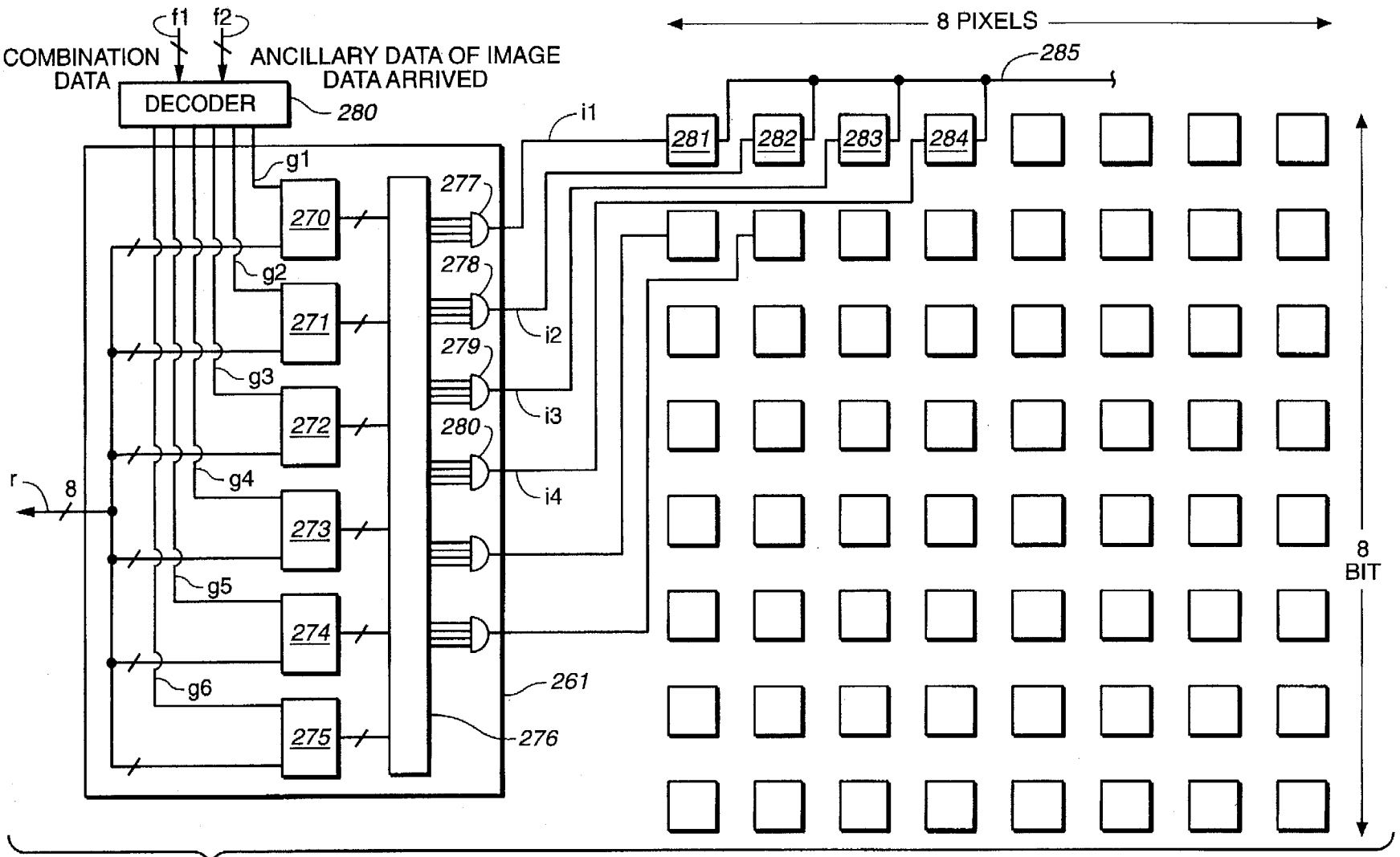
FIG. 24 shows the detailed structure of the word-unit/dot-unit data converter of FIG. 20.

FIG. 24 is an even more detailed drawing of the composition of switching circuit 261 and first buffer memory 262. In this drawing, combination data f1, which concerns the combination of the background image screen (screen A or B) and a color mode that have been set in advance in something such as a register as control data, and ancillary data f2, which concerns currently arrived image data h, are input to decoder 280. Ancillary data f2 is, for example, the screen number and color mode of image data h. After that, already-decoded control signals g1, g2, . . . , and g6 will be output. Control signals g1, g2, . . . , and g6 correspond to the six combinations shown in FIG. 21.

In FIG. 24, image data h and control signals g1, g2, . . . , and g6 are input to switching circuit 261. After the switching, image data i1, i2, i3, i4, etc. will be output. Switching circuit 261 contains selectors 270, 271, 272, 273, 274 and 275 as well as wiring section 276 and logical OR gates 277, 278, 279, 280, etc. In this embodiment, the capacity of the first buffer memory is 64 bits (8 dots by 8 dots). Each of the 64 output pins from switching circuit 261 are connected to the 64 memory cells, 281, 282, 283, 284, etc. All of the outputs of the memory cells, 281, 282, 283, 284, etc., are bound together as data bus 285 and form image data j shown in FIG. 20.

Figure 25:
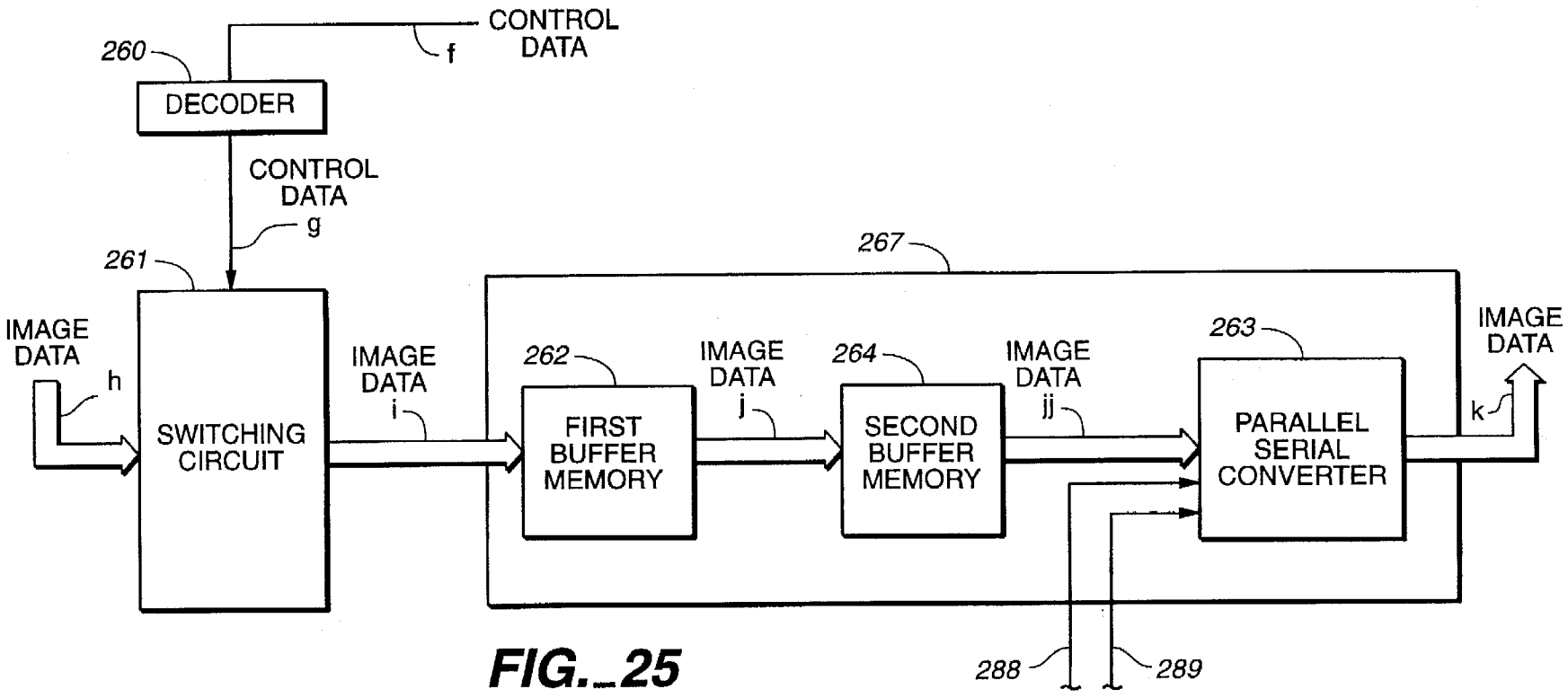
FIG. 25 is a block diagram that describes another example of the structure of the word-unit/dot-unit data converter.

FIG. 25 is an example of another configuration of the word-unit/dot-unit data converter. Its characteristic is that it has second buffer memory 264 between first buffer memory 262 and parallel-serial converter 263. In FIG. 25, the generation of control signal g by decoder 260, the obtaining of already-switched image data from image data h by switching circuit 261 and the obtaining of image data j, which rearranges to the output pins of first buffer memory 262, are the same as the operations of the word-unit/dot-unit data converter in FIG. 20.

Figure 26:
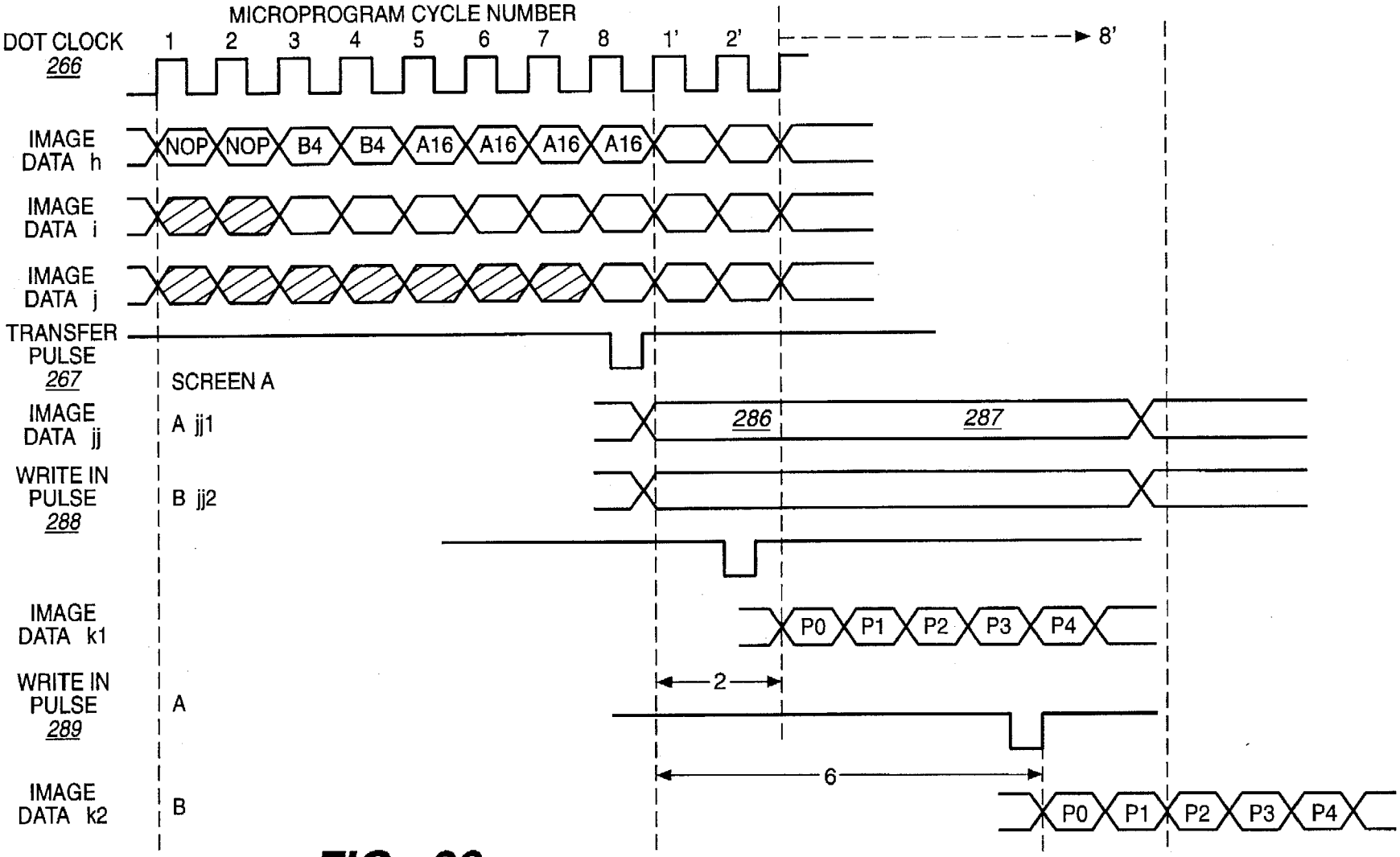
FIG. 26 is a drawing that shows the signal timing of each section in the word-unit/dot-unit data converter of FIG. 25.

Referring to FIGS. 25–26, image data j will be transferred all together from first buffer memory 262 to second buffer memory 264 simultaneously with transfer pulse 267. Second buffer memory 264 will output image data jj to parallel-serial converter 263 with transfer pulse 267 as a trigger. Here, component data 287 of image data jj has the same content as component data 286 of image data j and is data that is time-delayed.

Image data jj contains 16-color mode image data jj1, which corresponds to screen A, and contains 4-color mode image data jj2, which corresponds to screen B. As a trigger pulse for transferring data accumulated in second buffer memory 264 to parallel-serial converter 263, it is possible to control the amount of delay of the output image signal from parallel-serial converter 263 independently between screen A and screen B by providing two types of pulses, transfer pulse 288 for image data jj1, and transfer pulse 289 for image data jj2. In the case of the example in FIG. 26, image signal jj1, which is transferred by transfer (write) pulse 288, is output from parallel-serial converter 263 as two-dot delay image signal k1. Image signal jj2, which is transferred by transfer (write) pulse 289, is output from parallel-serial converter 263 as six-dot delay image signal k2.

By having second buffer register 264 in between, it is possible to independently control the amount of image data delay adjustment for each background image screen. To delay the image signal is equivalent to offsetting the position of the image on the display device. Therefore, by providing the above means, it is possible to offset and display for a multiple of background images as well as possible to independently scroll display a plurality of background images.

In such a case, as in the first embodiment, the scrolling of the character unit takes place by adjusting the access timing to memory 216. When less than the character unit, for example, in the case of this embodiment, when carrying out a scroll of less than eight dots by adjusting the amount of delay at second buffer register 264, it is possible to have an effective scroll display.

Figure 27:
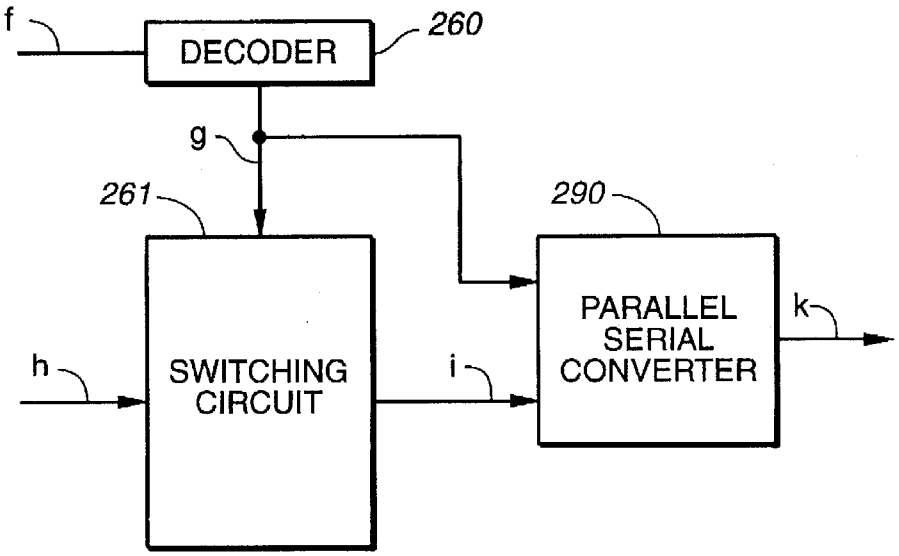
FIG. 27 is a block diagram that describes still another example of the structure of word-unit/dot-unit data converter.
Figure 29:
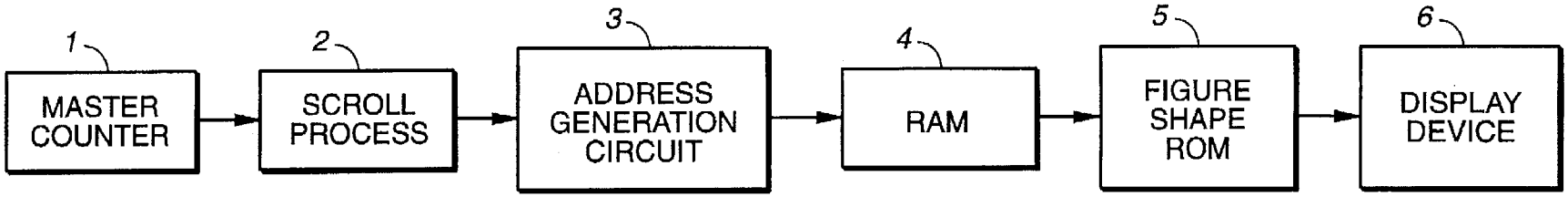
FIG. 29 (PRIOR ART)
FIG. 29 is a block diagram that describes the technology of the prior art.

FIG. 27 shows still another example of the composition of the word-unit/dot-unit data converter. Its characteristic is that by forming parallel-serial converter 290 as shown in FIG. 28, for example, it is possible to have a parallel-serial converter 290 that itself has a memory function that is random writable.

Parallel-Serial Converter Structure

Figure 28:
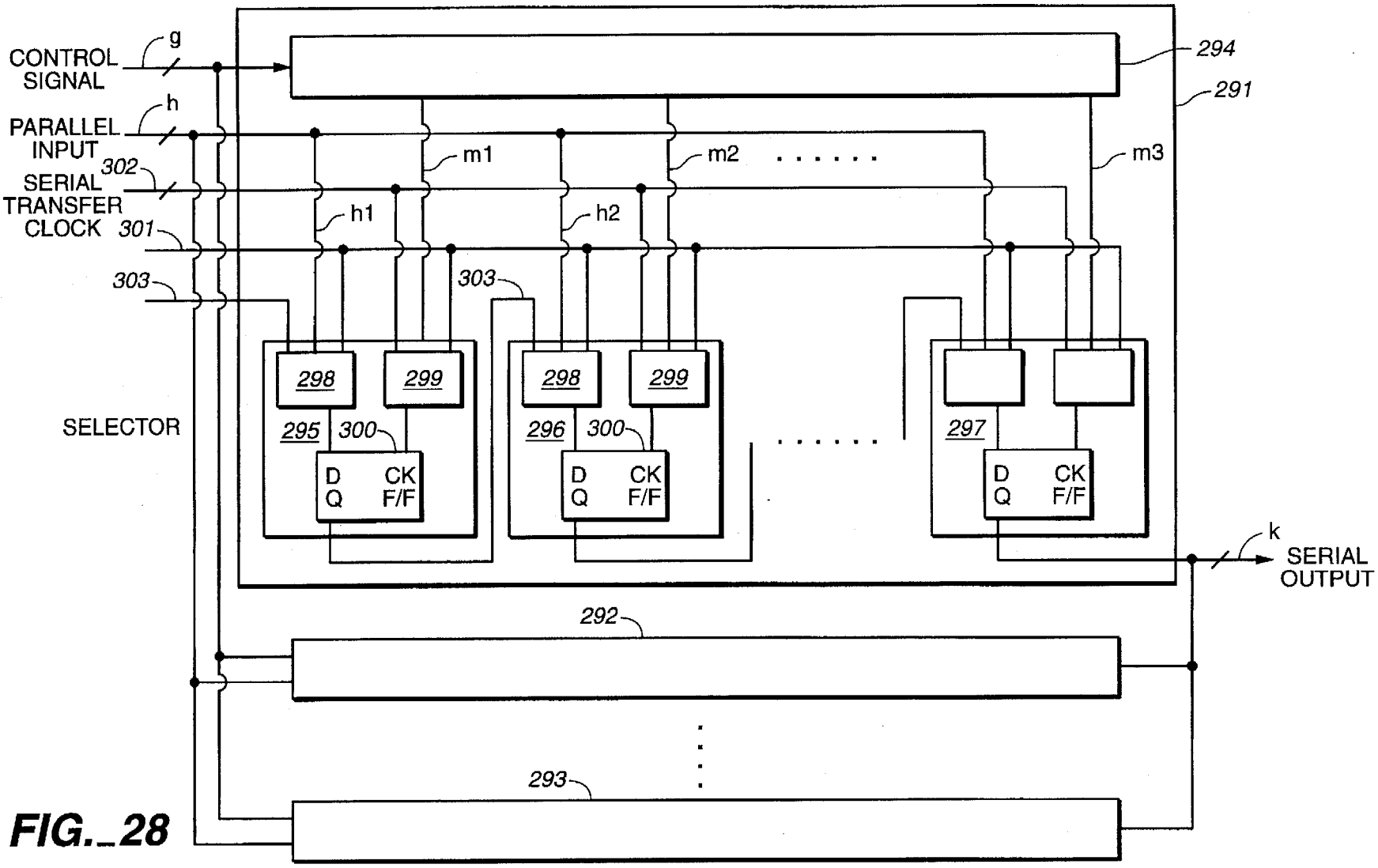
FIG. 28 is a block diagram that shows the detailed structure of the word-unit/dot-unit data converter in FIG. 27.

Referring to FIG. 28, circuit block 291 is the image data one bit parallel-serial converter. Circuit block 291 contains write pulse generation circuit 294, in which control signal g is input and which outputs write pulses m1, m2, . . . , m3, and contains a plurality (8 in this embodiment) of unit cells 295, 296, . . . , 297. Unit cell 295 contains selectors 298, 299 and flip-flop 300. The same applies to unit cells 296, . . . , and 297. Circuit blocks 292, . . . , and 293 are parallel-serial converters with one bit of image data and the same structure as circuit block 291. In the case of this embodiment, 8-bit parallel-serial converter 290, which has an 8-bit data width, is formed by eight 1-bit parallel-serial converters, 291, 292, . . . , and 293.

Parallel-Serial Converter Operation

Referring to FIG. 28, write pulse generation circuit 294 will generate write pulses m1, m2, . . . , and m3, based on receipt of control signal g, and transfer them to unit cells 295, 296, . . . , and 297. In an optional unit cell, for example, unit cell 296, if write enable mode/serial transfer mode signal 301 has specified the write enable mode, selector 298 will select component signal h2 of image data h and supply it to flip-flop 300 as parallel input. At this time, selector 299 will select write pulse m2 and supply it to clock input pin CK of flip-flop 300. Data is written to the unit cell as described above.

If the write enable mode/serial transfer mode signal 301 has specified the serial transfer mode, selector 298 will select output data 303 of the previous-step unit cell 295 and supply it to data input pin D of flip-flop 300 as serial input. At this time, selector 299 will select serial transfer block 302 and supply it to clock input pin CK of flip-flop 300. Serial data transfer takes place between the unit cells by means of the shift register operation as described above. It also is possible for the parallel-serial converter 290 to possess both an image data rearranging function and a parallel-serial conversion function at the same time, as described above.

In this way, by forming the image regeneration device as in the second embodiment, it is possible to accommodate both the normal mode and the enlargement, reduction and rotation modes. At such a time, it is possible to compensate for the image signal timing offset that appears between the two circuit means described above and obtain a normal mode and enlargement, reduction and rotation modes with matched display timing. In addition, the problem of the image data arrangement read from the memory means having a different arrangement from the display sequence, which is caused by the introduction of microprogram control, can be resolved by the addition of a small amount of hardware. Further, by using the circuit means shown in FIG. 25, a secondary effect, in which it is possible to adjust the image data delay in a programmable manner, can be obtained.

As described above, based on this invention, many types of display color modes, multiple screen displays, and a variety of display effects that are in demand for computer graphics equipment such as TV games, personal computer display devices and multi-media equipment, have become possible by implementing the many high-level functions that accommodate things such as complicated image processing in extremely small hardware. In addition, the number of steps to design the aforesaid hardware is fewer compared to not using this invention. As a result, it is possible to reduce costs when implementing an image regeneration device equipped with these high-level functions in an integrated circuit.

Moreover, by using microprograms to operate either part or all of the hardware, which implements the functions with which the image regeneration device is equipped, the following effects also will come about. That is, by rewriting the microprogram to be optimal with the content changes of the image data, it is possible always to maintain the utility effectiveness of memory 24, which is described in the first embodiment, at a high level. As a result, it is possible to have memory utilization without waste and increase the cost/performance ratio of products that use this truly-desired image regeneration device. Furthermore, as indicated in the second embodiment, it is possible to obtain an image regeneration device that has a broad range of freedom by doing things such as making the amount of scrolling for each screen programmable.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the subjoined claims.

What is claimed is:

1. An image regeneration device for generating a composite image on a display composed of multiple superimposed screens in which each screen has selected image characteristics, said image regeneration device comprising:

counter means for generating a series of initial coordinate signals, each coordinate signal associated with a pixel position on the display;

mode selection means coupled to the counter means, for operating on each coordinate signal and generating new coordinate signals defining images to be illustrated on different screens on the display, said mode selection means including:

register means for storing a plurality of parameters, one parameter for each screen;

selector means for selecting a given parameter from the register means;

modifying means coupled to the selector means and to the counter means for selectively modifying each initial coordinate signal according to the parameter selected by the selector means; and said mode selection means thereby operating on the initial coordinate signals to selectively generate new coordinates for scrolled images, enlarged images, reduced images and rotated images for each screen;

image memory means for outputting image data for each screen as a function of addresses supplied to its input;

address generator means coupled between the mode selection means and the image memory for generating addresses to the image memory as a function of the new coordinates generated by the mode selection means;

microprogram storage means for controlling the selector means and for providing an alternative source of addresses to the image memory; and whereby image portions for each screen are superimposed to form a composite image on the display in which each screen image portion can be selectively scrolled, enlarged, reduced or rotated as a function of the selected parameters.

2. The image regeneration device of claim 1, wherein said mode selection means comprises:

scroll means for generating new coordinate signals to cause an image on a screen to be scrolled by an amount defined by a selected parameter.

3. The image regeneration device of claim 2 wherein said mode selection means comprises:

reverse affine transformation means for generating new coordinate signals for enlarging, reducing or rotating an image for a screen as a function of a selected parameter.

4. The image regeneration device of claim 3 which further comprises:

region determination means, coupled to an output of the mode selection means for determining whether a new coordinate is within a predetermined region on the display.

5. The image regeneration device of claim 1 wherein said address generator means comprises:

a background attribute table (BAT) and a character generator (CG), with said microprogram storage means providing control signals to the background attribute table and character generator to selectively control the operation thereof.

6. The image regeneration device of claim 1 wherein said address generator means also utilizes color mode information and information about whether a reverse affine transformation is selected for each screen, to generate the addresses to the image memory.

7. The image regeneration device of claim 4 wherein the scroll means, reverse affine transformation means and said region determination means are connected together so that:

said counter means is coupled to an input of the scroll means, with an output of the scroll means providing an input to the reverse affine transformation means, and wherein an output of the reverse affine transformation means is coupled to an input of the region determination means, and wherein the output of the region determination means is coupled to an input of the address generator means.

8. An image regeneration apparatus that regenerates images to be shown on a display in which multiple screens are superimposed in a single screen, the apparatus comprising:

an initial coordinate signal generation means that generates initial coordinate signals that are to be the basis of coordinate signals associated with pixel locations on said display;

a coordinate transformation means that is coupled to said initial coordinate signal generation means and that transforms said initial coordinate signals into new coordinate signals for forming a given image based on parameters given for each of said multiple screens;

an address generation means that transforms the new coordinate signals based on address functions and thereby generates address signals;

an image data storage means for storing image data for said multiple screens, and from which said image data for respective screens is read out based on addresses generated by said address generation means; and a microprogram storage means that stores a microprogram containing a screen number code for each of said screens and controls said coordinate transformation means and said address generation means;

wherein, synchronously with the serial operation of the microprogram and according to said screen number code in the microprogram, said coordinate transformation and said address generation are performed for each of said screens in series and image data for each pixel according to the transformed coordinate signal for each screen is read out from said image data storage means.

9. An image regeneration apparatus of claim 8, wherein said read image data for each pixel on each screen is rearranged and outputted according to the order to be displayed on said display based on said microprogram.

10. An image regeneration apparatus of claim 8, wherein said coordinate transformation means includes a scroll means that transforms said initial coordinate signal into a new coordinate signal for forming an image scrolled according to an amount defined by a parameter selected based on said screen number code.

11. An image regeneration apparatus of claim 8, wherein said coordinate transformation means further includes a reverse affine transformation means that receives a coordinate signal outputted by said scroll means as an input and performs reverse affine transformation on the coordinate signal, and a new coordinate signal, for enlarging, reducing or rotating images on a screen, is transformed as a function selected based on said screen number code.

12. An image regeneration apparatus of claim 11 further includes a mode selection means for selecting a mode to transform said coordinate signal, and said mode selection means selects each mode for scrolling, enlarging, reducing or rotating images on a screen.

13. An image regeneration apparatus of claims 10, 11 or 12, wherein said coordinate transformation means further includes a region determination means receiving a coordinate signal outputted by said scroll means or reverse affine transformation means as an input, and which determines whether the inputted coordinate signal is within the region of any original image selected out of respective original images on multiple screens based on said screen number code, and based on the results of the determination the inputted coordinate signal is transformed into said new coordinate signal.

14. An image regeneration apparatus of claim 8, wherein said microprogram further contain an address selection code for selecting a CG address or a background attribute table address;

said image data includes image data of character images that is a partial image comprising a plurality of correlative pixels;

said address generator means includes a CG address generator means for generating addresses for said image data storage means that generates image data for the character images;

wherein, based on said new coordinate signal supplied to the CG address generator means and said microprogram, addresses for said image data storage means in which image data of the character images is stored are generated.

15. An image regeneration apparatus of claim 14, wherein said address generator means further includes a background attribute table address generator means for storing character codes comprising symbols representative of said character images, and wherein the character codes are read out based on said new coordinate signal supplied to the background attribute table address generator means and said microprogram, and addresses for said image data storage means are generated based on the character code and address selection code in said microprogram, and image data of the character images is read out based on the addresses.

16. An image regeneration apparatus of claim 13, wherein said initial coordinate signal is inputted to said scroll means, the coordinate signal scrolled by the scroll means is inputted to said reverse affine transformation means, the coordinate signal enlarged, reduced or rotated by the reverse affine transformation means is inputted to said region determination means, the coordinate signal outputted from the region determination means is inputted to said address generator means as said new coordinate signal according to the determination made by the region determination means with respect to whether the coordinate signal inputted to said region determination means is within the region of the original image, and said region determination is made with respect to the coordinate signal transformed by performing reverse affine transformation on said scrolled coordinate signal.

17. An image regeneration apparatus of claim 8, wherein said microprogram storage means stores multiple microprogram and includes a microprogram delay means that delays the reading of the microprogram from the microprogram storage means by one cycle where the microprogram are read out in a loop comprising multiple cycles, and wherein a transformation stage of said coordinate transformation means, a determination stage of said region determination means and a generation stage of said address generation means are sequentially processed in pipeline synchronously with the one-cycle delayed reading of the microprogram.

18. An image regeneration apparatus of claim 17, wherein a transformation stage of said coordinate transformation means includes said scroll stage or said reverse affine transformation stage, said address generation stage includes a stage in which said CG address is generated and a stage in which said background attribute table address is generated, and the transformation stage of said coordinate transformation means, the region determination stage, the background attribute table address generation stage and the CG address generation stage are sequentially processed in pipeline in the order as recited synchronously with said delayed microprogram processing.

19. An image regeneration apparatus of claim 18, wherein a cycle count included in the basic loop in which a round of the microprogram processing is completed is integer-multiplied by the number of pixels in the character's horizontal direction.

20. An image regeneration apparatus of claim 8, wherein said coordinate transformation means includes a reverse affine transformation means for forming at least enlarged, reduced or rotated images and a normal mode means for forming normal images; and further provided are:

a means that performs at least part of the reverse affine transformation operation prior to performing a reverse affine transformation operation per dot, a circuit means that rearranges and outputs the image data in the order to be displayed after accessing said image data storage means in said normal mode and a means that sets an effective display period to be coincident between said enlargement, reduction or rotation modes and a normal mode.

21. An image regeneration apparatus of claim 20, wherein the number of bits per word for said image data storage means is defined so as to be a common multiple of data word length per pixel in multiple color modes.

22. An image regeneration apparatus of claim 20, wherein accessing said image data storage means starts earlier by one character than the display start when the display mode is in said normal mode, and accessing said image data storage means starts after performing initial value calculation for reverse affine transformation prior to the display start when the display mode is in said enlargement, reduction or rotation mode.

23. An image regeneration apparatus comprising a means that generates coordinates of pixels for a display an image data storage means that stores image data for the pixels to be displayed on the display as a single screen in which multiple screens are superimposed, and an address generation means that generates addresses for the storage means based on the generated coordinates; wherein based on said microprogram containing screen number information and information of modes in which how many colors are to be displayed; and further provided are:

a switching means that selectively switches the image data for storing multiple image data read out from the image data storage means in a given storage region of a first memory buffer means, a first memory buffer means that stores switched image data, and a parallel serial conversion means that serially outputs image data for said multiple screens outputted by the first memory buffer means for each pixel according to the order in which image data is to be displayed.

24. An image regeneration apparatus of claim 23 further comprising:

a second memory buffer means that is disposed between said first memory buffer and said parallel serial conversion means and into which data to be stored in the first memory buffer means are transferred; and an input means that inputs transfer pulse signals so that a plurality of partial data of data stored in the second memory buffer means are transferred to said parallel serial conversion means respectively in a different timing; wherein said partial data are outputted with a delay according to the difference in timing of pulse signals with a different timing.

25. An image regeneration apparatus of claim 24, wherein said difference in timing represents an integer-multiplication of time intervals during which image data for one pixel is outputted, and a scroll amount is controlled for each screen according to the integer value.

26. An image regeneration method for regenerating images to be shown on a display in which multiple screens are superimposed in a single screen, the method comprising:

generating initial coordinate signals that are to be the basis of coordinate signals associated with pixel locations on said display;

transforming said initial coordinate signals into new coordinate signals for forming given images based on a given parameter for each of said multiple screens;

transforming the new coordinate signals based on address functions and thereby generating address signals;

reading out said image data for each screen from an image data storage means that stores image data for said multiple screens based on addresses generated by said address generation means;

controlling said coordinate transformation means and said address transformation means by means of microprogram containing screen number codes for each of said screens;

sequentially performing said coordinate transformation and said address generation for each of said screens synchronously with the sequential operation of the microprogram and according to said screen number code of the microprograms, and reading out image data from said image data storage means for each pixel associated with the transformed coordinate signals on each screen.

27. Apparatus for generating a composite image on a display composed of multiple superimposed screens in which each screen has selected image characteristics said apparatus comprising:

a microprogram storage means that contains a plurality of microprogram, each microprogram being associated with a particular screen and having a screen number code therefor;

counter means for generating a series of initial coordinate signals, each coordinate signal being associated with a pixel position on the display;

coordinate transformation means coupled to the counter means for transforming the initial coordinate signals into new coordinate signals for forming a given image on the display, the new coordinate signals being a function of parameters for each of the multiple screens;

image data storage means for storing image data associated with the multiple screens;

microprogram storage means that stores microprogram containing a screen number code for each of the screens; and said microprogram storage means being coupled to the coordinate transformation means and controlling, synchronously with the serial operation of the microprogram and in accordance with the screen number codes in the microprogram, the coordinate transformation means, whereby transformed image data portions for each screen is read out from the image memory in an order defined by the screen microprogram to thereby generate a composite image on the display.

* * * * *